US006730010B2

(12) United States Patent
Yamakawa et al.

(10) Patent No.: US 6,730,010 B2
(45) Date of Patent: May 4, 2004

(54) SHEET FOLDING METHOD, SHEET FOLDING APPARATUS, SHEET FINISHER EQUIPPED THEREWITH AND IMAGE FORMING APPARATUS FOR USED WITH THE SHEET FINISHER

(75) Inventors: Mikihiro Yamakawa, Hachioji (JP); Toshio Shida, Hachioji (JP); Hiroyuki Wakabayashi, Hachioji (JP); Tsuyoshi Tsuchiya, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/218,812

(22) Filed: Aug. 14, 2002

(65) Prior Publication Data

US 2003/0040415 A1 Feb. 27, 2003

(30) Foreign Application Priority Data

Aug. 23, 2001 (JP) ..... 2001-253076

(51) Int. Cl.[7] ..... B65H 45/14
(52) U.S. Cl. ..... 493/267; 493/424; 493/442
(58) Field of Search ..... 493/405, 408, 493/413, 415, 417, 424, 442, 445, 454, 267

(56) References Cited

U.S. PATENT DOCUMENTS 2,230,168 A * 1/1941 Spiess ..... 493/421
2,253,446 A * 8/1941 Spiess ..... 493/360
2,699,331 A * 1/1955 McGarvey et al. ..... 493/421
2,847,209 A * 8/1958 Olson ..... 493/421
3,089,695 A * 5/1963 Brooks ..... 493/419
3,511,013 A * 5/1970 Pahlitzsch ..... 53/412
3,616,069 A * 10/1971 Schwalbach ..... 156/444
3,627,305 A * 12/1971 Heigl et al. ..... 493/342
3,841,621 A * 10/1974 Brown ..... 493/8
4,225,128 A * 9/1980 Holyoke ..... 493/421
4,484,905 A * 11/1984 Ashburner ..... 493/415
4,643,705 A * 2/1987 Bober ..... 493/444
4,781,667 A * 11/1988 Kitai ..... 493/359
5,044,617 A * 9/1991 Roberts ..... 270/45
5,169,376 A * 12/1992 Ries et al. ..... 493/445
5,364,332 A * 11/1994 Gray, Jr. ..... 493/23
5,738,620 A * 4/1998 Ebner et al. ..... 47/12
6,592,506 B1 * 7/2003 Lyga ..... 493/424

* cited by examiner

*Primary Examiner*—Paul Durand
(74) *Attorney, Agent, or Firm*—Muserlian, Lucas and Mercanti

(57) ABSTRACT

A sheet folding method has the first introduction process to introduce a sheet between the first rotary folding body and the first rotary pressure-contact body, and between the second rotary folding body and the second rotary pressure-contact body, respectively; the first folding process in which, under the condition that the first and second rotary folding bodies are in contact with the first and second rotary pressure-contact bodies, respectively, and rotated in the reversal direction to each other, thereby the conveying force of reversal directions to each other is acted and the sheet is bent and a fold is formed, and the fold of the sheet is conveyed between the first and second rotary folding bodies thereby the sheet is folded; the second introduction process to introduce the sheet folded by the first folding process using the similar structure to the first introduction process; and the second folding process using the similar steps to the first folding process.

16 Claims, 15 Drawing Sheets

FIG. 5 ( a )
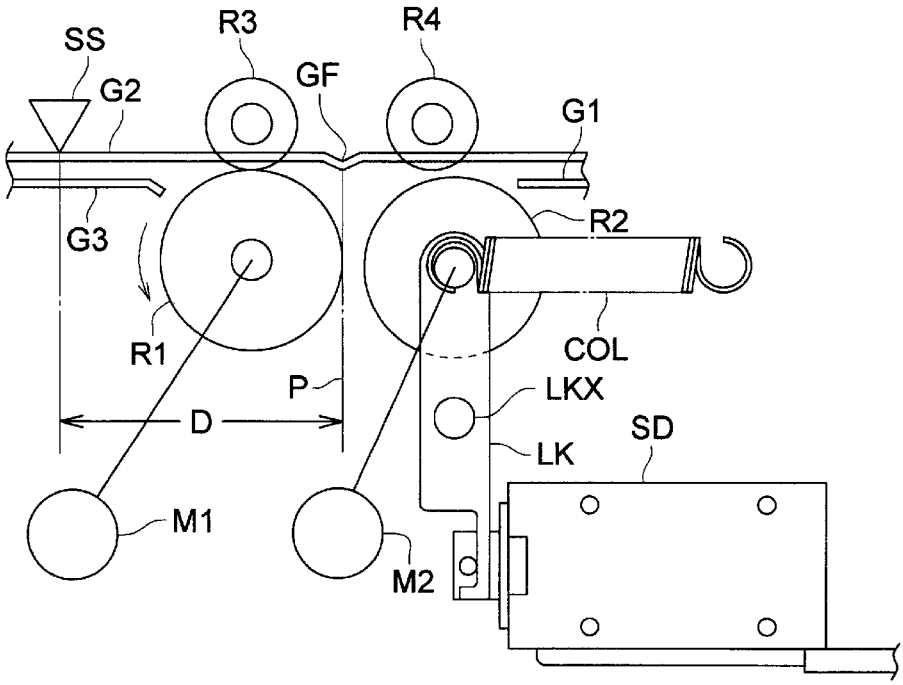
FIG. 5 ( b )
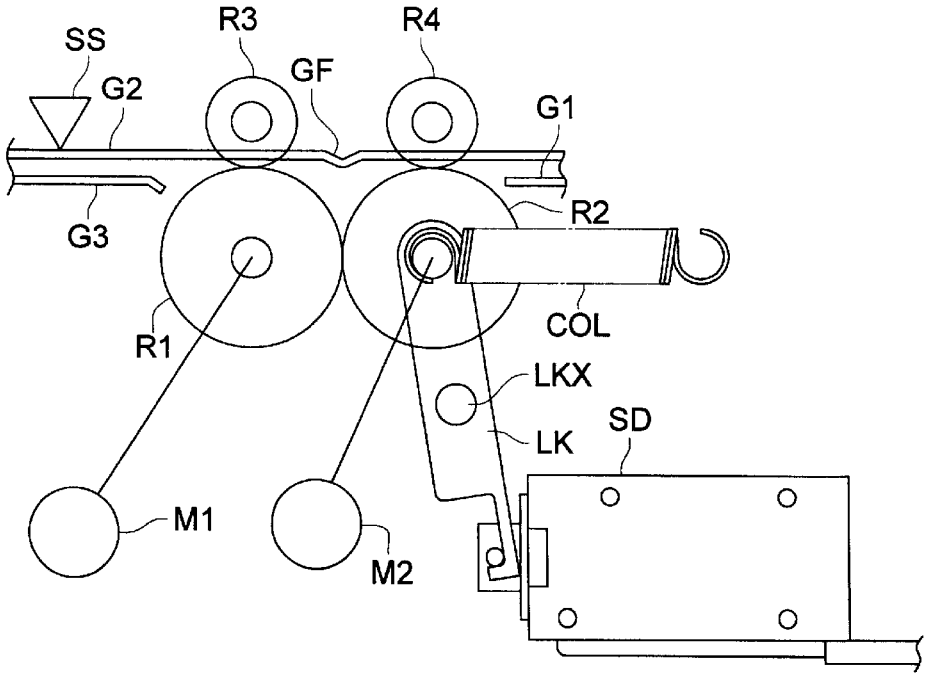

FIG. 6 ( a )
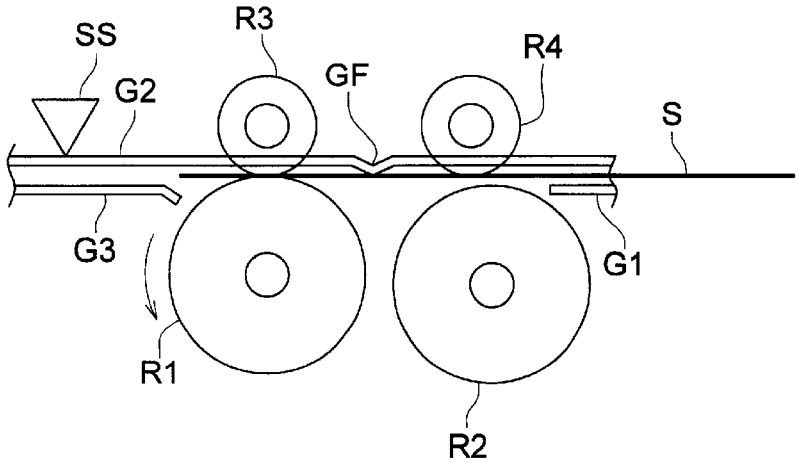
FIG. 6 ( b )
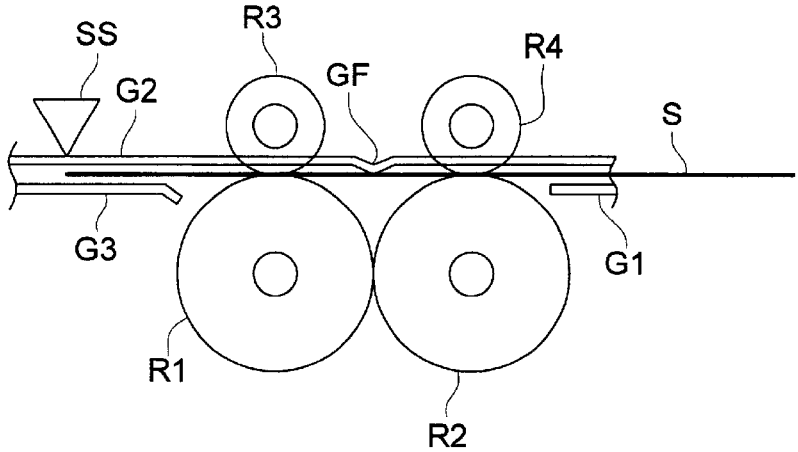
FIG. 6 ( c )
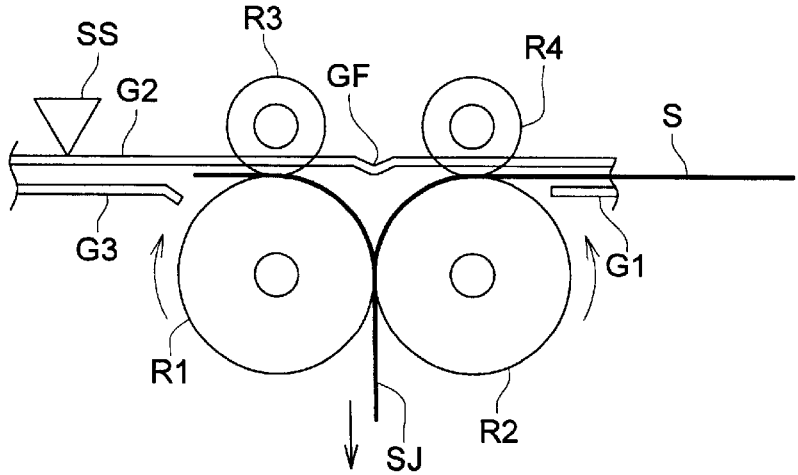

FIG. 13 ( a )
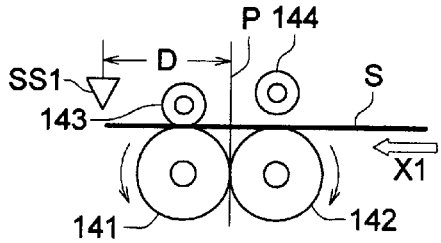
FIG. 13 ( b )
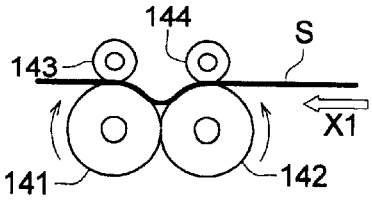
FIG. 13 ( c )
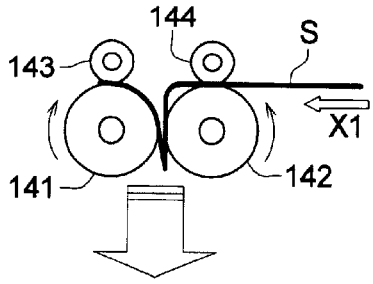
FIG. 13 ( d )
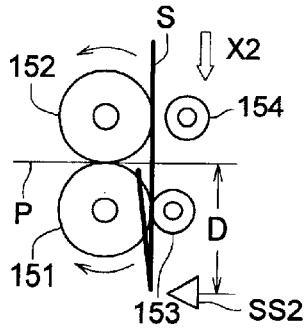
FIG. 13 ( e )
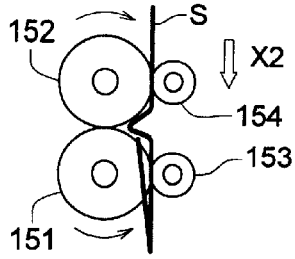
FIG. 13 ( f )
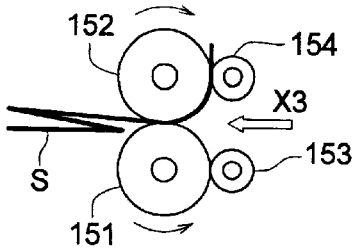

FIG. 15 ( a )
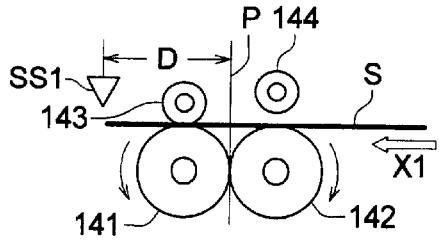
FIG. 15 ( b )
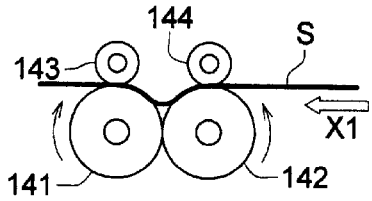
FIG. 15 ( c )
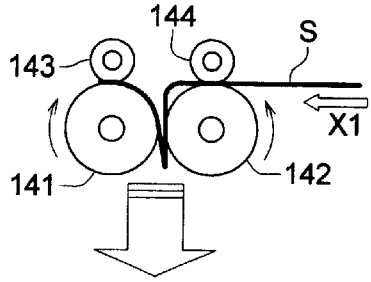
FIG. 15 ( d )
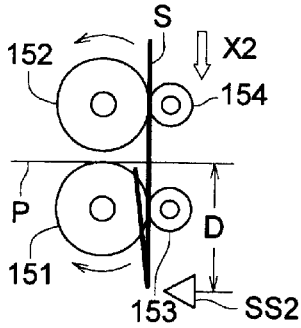
FIG. 15 ( e )
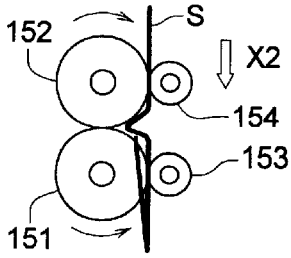
FIG. 15 ( f )
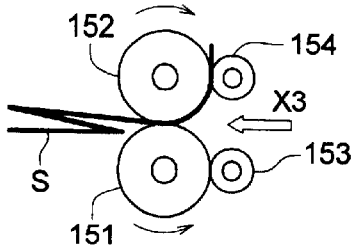

FIG. 16 ( a )
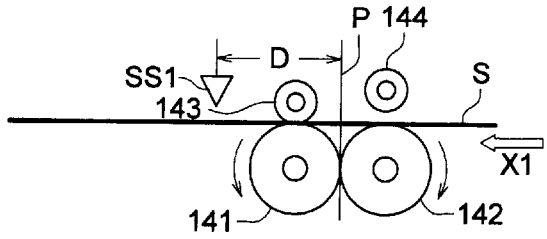
FIG. 16 ( b )
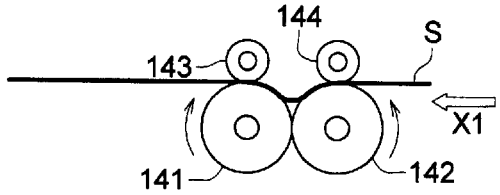
FIG. 16 ( c )
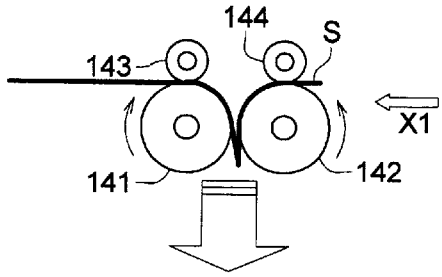
FIG. 16 ( d )
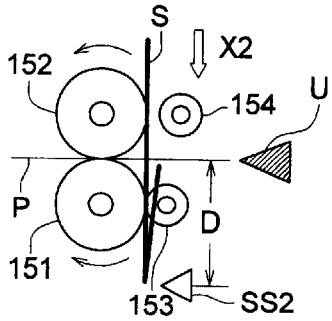
FIG. 16 ( e )
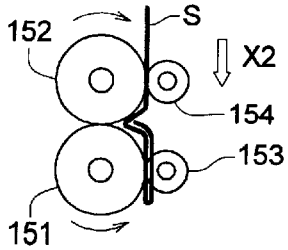
FIG. 16 ( f )
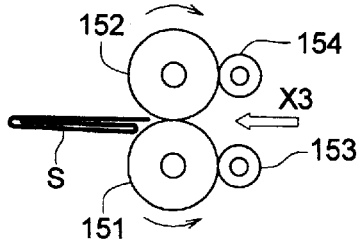

SHEET FOLDING METHOD, SHEET FOLDING APPARATUS, SHEET FINISHER EQUIPPED THEREWITH AND IMAGE FORMING APPARATUS FOR USED WITH THE SHEET FINISHER

BACKGROUND OF THE INVENTION

The present invention relates to a sheet folding method for folding the sheet, sheet folding apparatus, and sheet finisher by which the sheet on which an image is formed is folded after the image formation, and image forming apparatus.

In Japanese Tokkaihei No. 10-194586, or Tokkai No. 2002-060127, as the sheet folding apparatus, the apparatus by which the folding is conducted by using a knife-like folding member, or an apparatus by which, by pressing the sheet leading edge to the stopper and conveying the sheet, the sheet is bent and folded, is proposed.

In the former folding apparatus, the apparatus becomes large because the knife-like folding member is reciprocally moved, and there is a problem when it is used for the sheet finisher used as an auxiliary device of the image forming apparatus, and in the latter folding apparatus, there is a problem that it is difficult to fold the sheet at the accurate position.

SUMMARY OF THE INVENTION

An object of the present invention is to solve the above problem in the conventional sheet folding apparatus.

The object of the present invention is attained by any one of the following Structures (1) to (20).

(1) A sheet folding method which is characterized in that: it has the first introduction process to introduce a sheet between the first rotary folding body and the first rotary pressure-contact body, and between the second rotary folding body and the second rotary pressure-contact body, by using the first conveying means composed of the first rotary folding body and the first rotary pressure-contact body and the second conveying means which is composed of the second rotary folding body and the second rotary pressure-contact body and arranged upstream of the first conveying means; the first folding process in which, under the condition that the first rotary folding body is in contact with the first rotary pressure-contact body, the second rotary folding body is in contact with the second rotary pressure-contact body, and the first rotary folding body is in contact with the second rotary folding body, when the first and second rotary folding bodies are rotated in the reversal direction to each other, the conveying force of reversal directions to each other is acted by the first conveying means and the second conveying means and the sheet is bent and a fold is formed, and the fold of the sheet is conveyed between the first rotary folding body and the second rotary folding body and the sheet is folded; the second introduction process to introduce the sheet folded by the first folding process between the third rotary folding body and the third rotary pressure-contact body, and between the fourth rotary folding body and the fourth rotary pressure-contact body, by using the third conveying means composed of the third rotary folding body and the third rotary pressure-contact body, and the fourth conveying means which is composed of the fourth rotary folding body and the fourth rotary pressure-contact body and arranged upstream the third conveying means; and the second folding process in which, under the condition that the third rotary folding body is in contact with the third rotary pressure-contact body, the fourth rotary folding body is in contact with the fourth rotary pressure-contact body, and the third rotary folding body is in contact with the fourth rotary folding body, when the third and fourth rotary folding bodies are rotated in the reversal direction to each other, the conveying force of reversal directions to each other is acted by the third conveying means and the fourth conveying means and the sheet is bent and a fold is formed, and the fold of the sheet is conveyed between the third rotary folding body and the fourth rotary folding body and the sheet is folded.

(2) A sheet folding method according to Structure (1), wherein, in the first introduction process, the first rotary pressure-contact body is brought into contact with the first rotary folding body, and the second rotary folding body and the second rotary pressure-contact body are separated from each other, and the sheet is conveyed and introduced by the first conveying means.

(3) A sheet folding method according to Structure (1), wherein, in the first introduction process, the second rotary pressure-contact body is brought into contact with the second rotary folding body, and the first rotary folding body and the first rotary pressure-contact body are separated from each other, and the sheet is conveyed and introduced by the second conveying means.

(4) A sheet folding method according to Structure (1), wherein, in the second introduction process, the third rotary pressure-contact body is brought into contact with the third rotary folding body, and the fourth rotary folding body and the fourth rotary pressure-contact body are separated from each other, and the sheet is conveyed and introduced by the third conveying means.

(5) A sheet folding method according to Structure (1), wherein, in the second introduction process, the fourth rotary pressure-contact body is brought into contact with the fourth rotary folding body, and the third rotary folding body and the third rotary pressure-contact body are separated from each other, and the sheet is conveyed and introduced by the fourth conveying means.

(6) A sheet folding method according to Structure (1), wherein, in the first introduction process, the first rotary pressure-contact body is brought into contact with the first rotary folding body, and the second rotary folding body is separated from the first rotary folding body and the second rotary pressure-contact body from each other, and by driving the first rotary folding body, the sheet is conveyed and introduced by the first conveying means.

(7) A sheet folding method according to Structure (1), wherein, in the first introduction process, the second rotary pressure-contact body is brought into contact with the second rotary folding body, and the first rotary folding body is separated from the second rotary folding body and the first rotary pressure-contact body from each other, and by driving the second rotary folding body, the sheet is conveyed and introduced by the second conveying means.

(8) A sheet folding method according to Structure (1), wherein, in the second introduction process, the third rotary folding body is brought into contact with the third rotary pressure-contact body, and the fourth rotary folding body is separated from the third rotary folding body and the fourth rotary pressure-contact body from each other, and by driving the third rotary folding body, the sheet is conveyed and introduced by the third conveying means.

(9) A sheet folding method according to Structure (1), wherein, in the second introduction process, the fourth rotary folding body is brought into contact with the fourth rotary pressure-contact body, and the third rotary folding body is separated from the fourth rotary folding body and the third rotary pressure-contact body from each other, and by driving the forth rotary folding body, the sheet is conveyed and introduced by the fourth conveying means.

(10) A sheet folding method according to Structure (1), wherein, in the first introduction process, under the condition that the first rotary pressure-contact body is separated from the first rotary folding body, and the second rotary pressure-contact body is separated from the second rotary folding body, the sheet is introduced by the introduction means.

(11) A sheet folding method according to Structure (1), wherein, in the second introduction process, under the condition that the third rotary pressure-contact body is separated from the third rotary folding body, and the fourth rotary pressure-contact body is separated from the fourth rotary folding body, the sheet is introduced by the introduction means.

(12) A sheet folding method according to Structure (1), wherein, in the first introduction process, the first rotary folding body and the second rotary folding body are separated from each other, and under the condition that the first rotary pressure-contact body is brought into contact with the first rotary folding body, and the second rotary pressure-contact body is brought into contact with the second rotary folding body, when the first and second folding rotation bodies are rotated in the same direction, the sheet is introduced.

(13) A sheet folding method according to Structure (12), wherein, in the first folding process, either one of the first or the second rotary folding body is driven by the drive means, and the other one is driven.

(14) A sheet folding method according to Structure (1), wherein, in the second introduction process, the third rotary folding body and the fourth rotary folding body are separated from each other, and under the condition that the third rotary pressure-contact body is brought into contact with the third rotary folding body, and the fourth rotary pressure-contact body is brought into contact with the fourth rotary folding body, when the third and fourth rotary folding bodies are rotated in the same direction, the sheet is introduced.

(15) A sheet folding method according to Structure (14), wherein, in the first folding process, either one of the third or the fourth rotary folding body is driven by the drive means, and the other one is driven.

(16) A sheet folding method according to Structures (1) to (15), wherein, in the first and the second folding processes, by the first guiding means arranged between the first conveying means and the second conveying means, and the second guiding means arranged between the third conveying means and the fourth conveying means, the sheet is guided so that it bends toward one direction.

(17) A sheet folding apparatus which has: the first conveying means composed of the first rotary folding body and the first rotary pressure-contact body; the second conveying means which is composed of the second rotary folding body and the second rotary pressure-contact body and arranged upstream of the first conveying means; the first folding section having the first displacement means and the first drive means which drives at least one of the first rotary folding body and the second rotary folding body; and the second folding section having the third conveying means composed of the third rotary folding body and the third rotary pressure-contact body, the fourth conveying means which is composed of the fourth rotary folding body and the fourth rotary pressure-contact body and arranged upstream of the third conveying means, the second displacement means and the second drive means which drives at least one of the third rotary folding body and the fourth rotary folding body, the sheet folding apparatus is characterized in that the first folding section folds the sheet at a first position thereof by one of the following operations A, B, C, and D; and the second folding section folds the sheet at a second position different from the first position by one of the following operations E, F, G and H, where the operation A represents that the first rotary pressure-contact body is brought into contact with the first rotary folding body, the second rotary folding body is brought into contact with the first rotary folding body, the first driving device drives the first rotary folding body in a condition that the second rotary pressure-contact body is separated from the second rotary folding body, thereby the sheet is conveyed and introduced to the first folding section by the first rotary folding body and the first pressure-contact body, then the first displacement device brings the first rotary pressure-contact body and the second rotary pressure-contact body into contact with the first folding body and the second folding body, respectively, and the first driving device drives the first rotary folding body and the second rotary folding body so as to be rotated in a direction opposite to each other, thereby conveyance force in an opposite direction is exerted on the sheet, the sheet is bent, a fold is formed on the sheet, and then the sheet is folded by making the fold to pass between the first and second rotary folding bodies;

the operation B represents that the first rotary pressure-contact body is brought into contact with the first rotary folding body, the first driving device drives the first rotary folding body in a condition that the second rotary folding body is separated from the first rotary folding body and the second rotary pressure-contact body, thereby the sheet is conveyed and introduced to the first folding section by the first rotary folding body and the first pressure-contact body, then the first displacement device brings the second rotary folding body into contact with the first rotary folding body and the second rotary pressure-contact body, and the first driving device drives the first rotary folding body and the second rotary folding body so as to be rotated in a direction opposite to each other, thereby conveyance force in an opposite direction is exerted on the sheet, the sheet is bent, a fold is formed on the sheet, and then the sheet is folded by making the fold to pass between the first and second rotary folding bodies;

the operation C represents that the first rotary pressure-contact body and the second rotary pressure-contact body are brought into contact with the first rotary folding body and the second rotary folding body, respectively, the first driving device drives the first rotary folding body and the second rotary folding body so as to be rotated in the same direction in a condition that the first rotary folding body is separated from the second rotary folding body, the first displacement device brings the first rotary folding body into contact with the second rotary folding body, and the first driving device drives the first rotary folding body and the second rotary folding body so as to be rotated in a direction opposite to each other, thereby conveyance force in an opposite direction is exerted on the sheet, the sheet is bent, a fold is formed on the sheet, and then the sheet is folded by making the fold to pass between the first and second rotary folding bodies;

the operation D represents that the first driving device drives the sheet in conditions that the first rotary pressure-contact body and the second rotary pressure-contact body are separated from the first rotary folding body and the second rotary folding body, respectively, the first displacement device brings the first rotary pressure-contact body and the second rotary pressure-contact body into contact with the first rotary folding body and the second rotary folding body, respectively, and the first driving device drives the first rotary folding body and the second rotary folding body so as to be rotated in a direction opposite to each other, thereby conveyance force in an opposite direction is exerted on the sheet, the sheet is bent, a fold is formed on the sheet, and then the sheet is folded by making the fold to pass between the first and second rotary folding bodies, the operation E represents that the third rotary pressure-contact body is brought into contact with the third rotary folding body, the fourth rotary folding body is brought into contact with the third rotary folding body, the second driving device drives the third rotary folding body in a condition that the fourth rotary pressure-contact body is separated from the fourth rotary folding body, thereby the sheet folded by the first folding section is conveyed and introduced to the second folding section by the third rotary folding body and the first pressure-contact body, then the second displacement device brings the third rotary pressure-contact body and the fourth rotary pressure-contact body into contact with the third rotary folding body and the fourth rotary folding body, respectively, and the second driving device drives the third rotary folding body and the fourth rotary folding body so as to be rotated in a direction opposite to each other, thereby conveyance force in an opposite direction is exerted on the sheet, the sheet is bent, a fold is formed on the sheet, and then the sheet is folded by making the fold to pass between the third and fourth rotary folding bodies;

the operation F represents that the third rotary pressure-contact body is brought into contact with the third rotary folding body, the second driving device drives the third rotary folding body in a condition that the fourth rotary folding body is separated from the third rotary folding body and the fourth rotary pressure-contact body, thereby the sheet is conveyed and introduced to the second folding section by the third rotary folding body and the first pressure-contact body, then the second displacement device brings the fourth rotary folding body into contact with the third rotary folding body and the fourth rotary pressure-contact body, and the second driving device drives the third rotary folding body and the fourth rotary folding body so as to be rotated in a direction opposite to each other, thereby conveyance force in an opposite direction is exerted on the sheet, the sheet is bent, a fold is formed on the sheet, and then the sheet is folded by making the fold to pass between the third and fourth rotary folding bodies;

the operation G represents that the third rotary pressure-contact body and the fourth rotary pressure-contact body are brought into contact with the third rotary folding body and the fourth rotary folding body, respectively, the second driving device drives the third rotary folding body and the fourth rotary folding body so as to be rotated in the same direction in a condition that the third rotary folding body is separated from the fourth rotary folding body, the second displacement device brings the third rotary folding body into contact with the fourth rotary folding body, and the second driving device drives the third rotary folding body and the fourth rotary folding body so as to be rotated in a direction opposite to each other, thereby conveyance force in an opposite direction is exerted on the sheet, the sheet is bent, a fold is formed on the sheet, and then the sheet is folded by making the fold to pass between the third and fourth rotary folding bodies; and the operation H represents that the second driving device drives the sheet in conditions that the third rotary pressure-contact body and the fourth rotary pressure-contact body are separated from the third rotary folding body and the fourth rotary folding body, respectively, the second displacement device brings the third rotary pressure-contact body and the fourth rotary pressure-contact body into contact with the third rotary folding body and the fourth rotary folding body, respectively, and the second driving device drives the third rotary folding body and the fourth rotary folding body so as to be rotated in a direction opposite to each other, thereby conveyance force in an opposite direction is exerted on the sheet, the sheet is bent, a fold is formed on the sheet, and then the sheet is folded by making the fold to pass between the third and fourth rotary folding bodies.

(18) A sheet folding apparatus according to Structure (17), wherein the first folding section and the second folding section are arranged at a distance which is larger than half the maximum length of the sheet to be folded.

(19) A sheet finisher which is characterized in that it has the sheet folding apparatus according to Structure (17) or (18).

(20) An image forming apparatus which is characterized in that it has the sheet folding apparatus according to Structure (17) or (18).

BRIEF DESCRIPTION OF THE DRAWINGS

FIGS. 5(*a*) and 5(*b*) are views showing the structure of the sheet folding apparatus according to an Embodiment 3 of the present invention.

FIGS. 6(*a*)–6(*c*) are views showing sheet folding processes in the sheet folding method according to the Embodiment 3 of the present invention.

FIGS. 13(*a*)–13(*f*) are views showing an example of a Z-folding process to fold 2 portions of the sheet.

FIGS. 15(*a*)–15(*f*) are views showing yet another example of the Z-folding process to fold 2 portions of the sheet.

FIGS. 16(*a*)–16(*f*) are views showing an example of 3-folding process to fold 2 portions of the sheet at ⅓ positions of the length of the sheet.

DETAILED DESCRIPTION OF THE PREFERRED EMBODIMENT

<Sheet Folding Apparatus>

Figure 1:
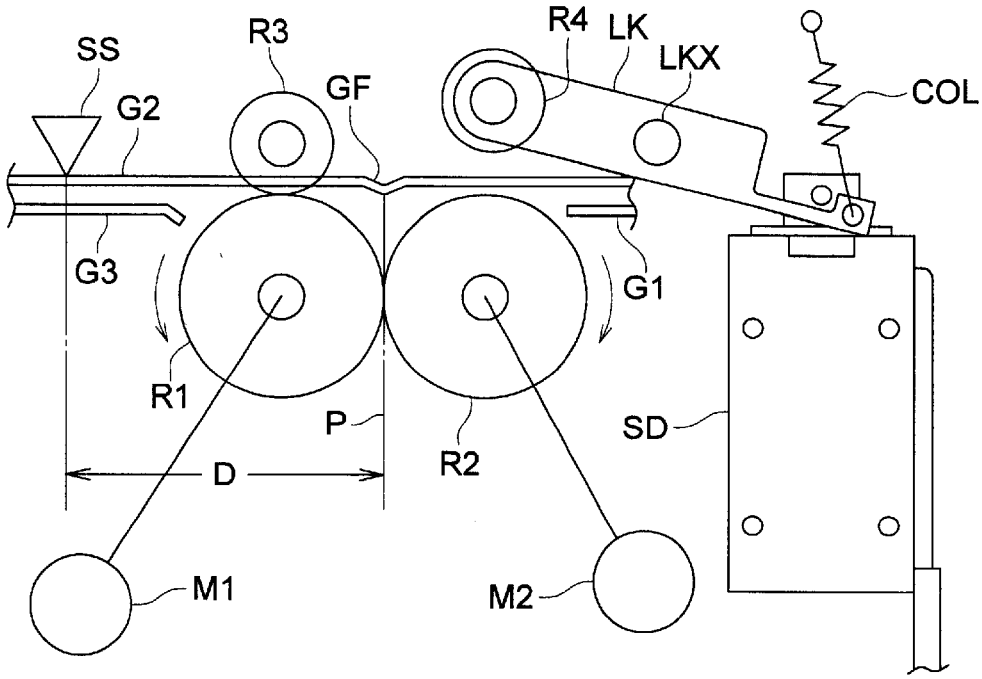
FIGS. 1(*a*) and 1(*b*) are views showing the structure of a sheet folding apparatus according to an Embodiment 1 of the present invention.
Figure 1:
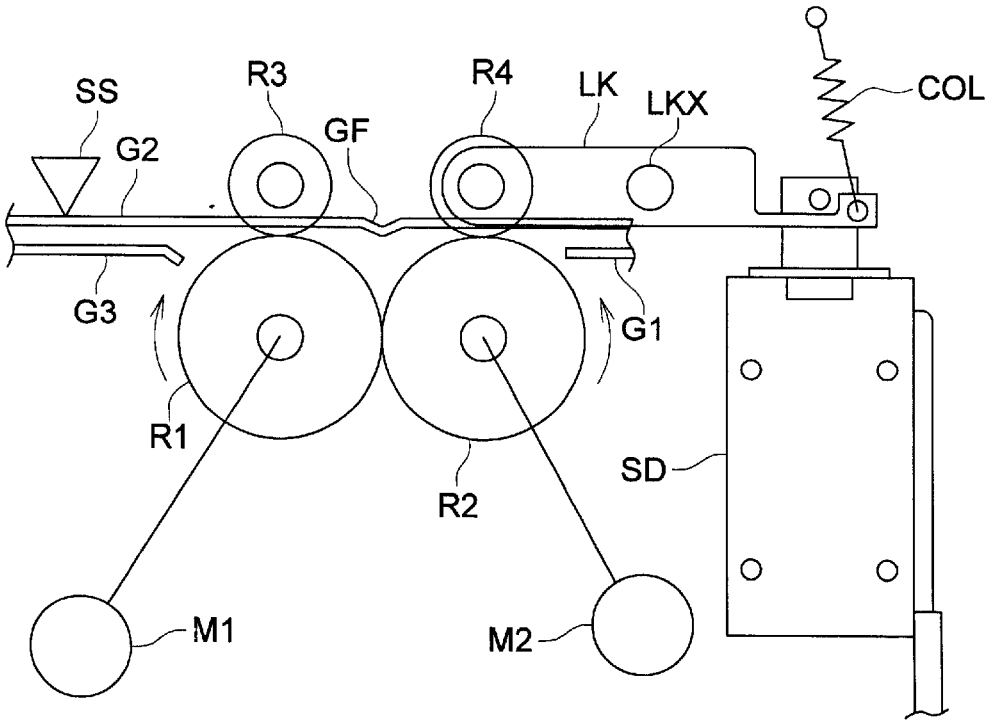

FIG. 1(*a*) and 1(*b*) show the structure of a sheet folding apparatus according to an Embodiment 1 of the present invention.

The first conveying means has the first folding roller R1 as the first rotary folding body and the first pressure contact roller R3 as the first pressure contact rotating body, and the second conveying means has the second folding roller R2 as the second rotary folding body and the second pressure contact roller R4 as the second rotary pressure-contact body. As the first and second folding roller R1, R2 and the first and second pressure contact roller R3 and R4, a roller formed of a high frictional material such as rubber is used.

Rotation axes of the first folding roller R1, the first pressure contact roller R3 and the second folding roller R2 are fixed, and the first pressure contact roller R3 is rotated by being driven by the first folding roller R1. The rotation axis of the second pressure contact roller R4 is provided to a lever LK and displaceable. The second pressure contact roller R4 is brought into contact with, and separated from the second folding roller R2, and when in contact with it, it is rotated by being driven by the second folding roller R2. Reference signs G1–G3 are guide members to guide the sheet, and the guide member G2 has a protrusion GF at the intermediate position between the first conveying means and the second conveying means. The protrusion GF as the guide means regulates the bending of the sheet in one direction (downward in the view). The lever LK is rotatably supported by an axis LKK, and one end (right end in the view) is connected to a solenoid SD, and the other end supports the second contact pressure roller R4. The lever LK is forced counter clockwise by a coil spring COL, and by turning on of the solenoid SD, it is rotated clockwise and as shown in FIG. 1(*a*), the second pressure control roller R4 is separated from the second folding roller R2, and by turning off of the solenoid SD, as shown in FIG. 1(*b*), the second pressure contact roller R4 is brought into pressure contact with the second folding roller R2. As described above, the lever LK to displace the rotation axis of the second pressure contact roller R4 and the solenoid SD structure the displacement means.

Reference sign SS is a sensor as a detection means for detecting the leading edge of the sheet, and a light sensor or micro switch is used.

Figure 2:
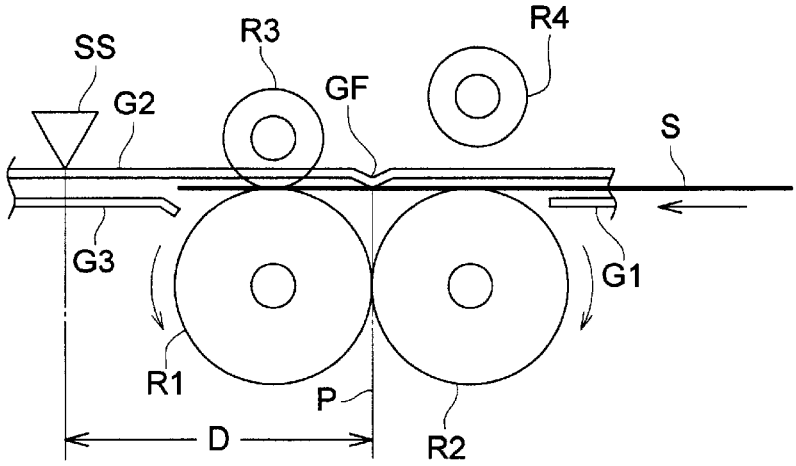
FIGS. 2(*a*)–2(*c*) are views showing sheet folding processes in the sheet folding method according to the Embodiment 1 of the present invention.
Figure 2:
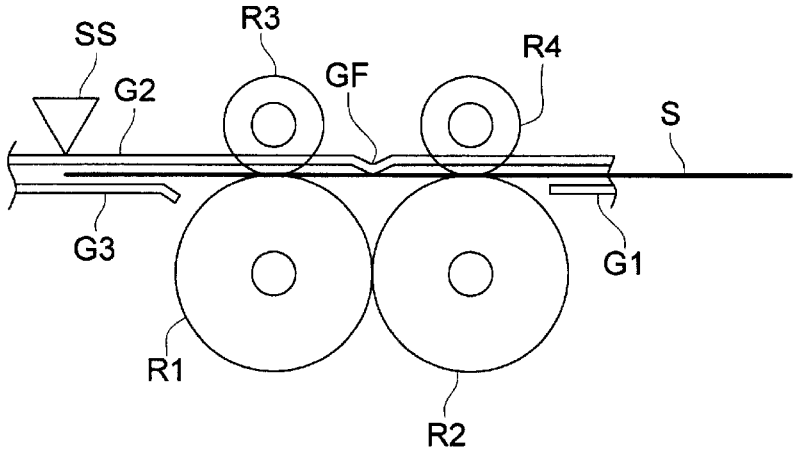
Figure 2:
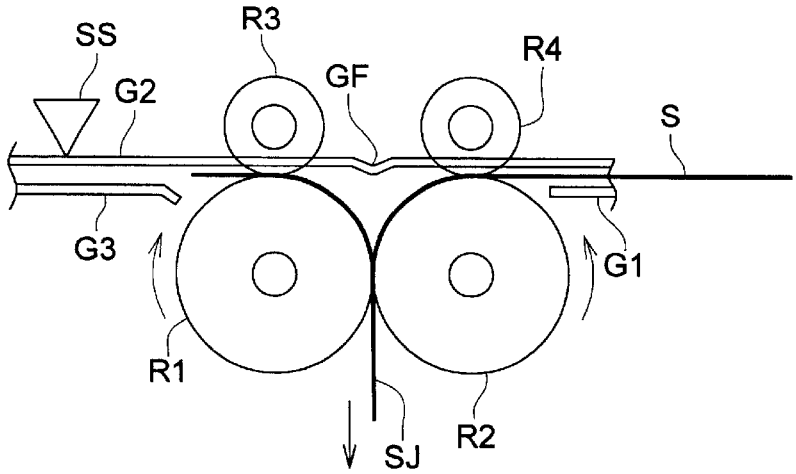

FIGS. 2(*a*)–2(*c*) show the folding process in the folding method of the sheet according to Embodiment 1 of the present invention, and FIG. 2(*a*) shows the introduction process, FIG. 2(*b*) shows a start stage of the folding process, and FIG. 2(*c*) shows the folding process.

In the introduction process in FIG. 2(*c*), the solenoid SD is turned on, and the second pressure contact roller R4 is separated from the second folding roller R2 by the drive of the solenoid SD.

By a stepping motor M1 as a drive means, the first folding roller R1 is rotated counter clockwise as shown an arrow and the sheet S is conveyed from right to left as shown by an arrow, and introduced between the first folding roller R1 and the first pressure contact roller R3, and between the second folding roller R2 and the second pressure contact roller R4. In this connection, in the introduction process, because the second conveying means has no conveying function, the second folding roller R2 is cut off from a stepping motor M2 as the drive means, and the second folding roller R2 is driven by the first folding roller R1.

FIG. 2(*b*) shows the start stage of the folding process in which, according to a sheet leading edge detection signal of the sensor SS, the conveying of the sheet S is stopped, and the second pressure contact roller R4 is brought into contact with the second folding roller R2.

In the stage at which the sensor SS detects the leading edge of the sheet, the first folding roller R1 is stopped according to the sheet leading edge detection signal, and solenoid SD is turned off, and by the urge of the coil spring COL, the second pressure contact roller R4 is displaced and brought into contact with the second folding roller R2. The first and second pressure rollers R3 and R4 are brought into pressure contact with the first and second folding rollers R1 and R2, respectively, by a predetermined pressure so that the first and second conveying means have the conveying force by which the bending can be given to the sheet S.

Next, by the clockwise rotation of the first folding roller R1 by the stepping motor M1 as the drive means and the counter clockwise rotation of the second folding roller R2 by the stepping motor M2 as the drive means, because the conveying force which is reversing direction to each other is applied by the first conveying means and second conveying means to the sheet S, as shown in FIG. 2(*c*), the sheet S is bent and a fold SJ is formed. By the rotation of the first and second folding rollers R1, R2, the fold SJ passes between these rollers, and the sheet S is folded.

In the bend start of the sheet S in the initial stage of the process of FIG. 2(*c*), the protruded portion GF of the guide member G2 acts as the guide member which gives a bend in the predetermined direction to the predetermined position of the sheet S. The protruded portion GF is formed in such a manner that the apex is positioned at the middle position between the nip of the first folding roller R1 and the first pressure-contact roller R3, and the nip of the second folding roller R2 and the second pressure-contact roller R4.

The position at which the fold SJ is formed, is an almost intermediate position, and as shown in the drawing, it is the reference position P which is a projection position to the introduction path of the contact position of the first folding roller R1 with the second folding roller R2. In this manner, it can be said that the reference position P is the position on the introduction path of the tangent line of the outer periphery of the first folding roller R1 which is the fixed roller.

The position of the fold SJ on the sheet S is set by the sheet leading edge detection position of the sensor SS, and the position of the sensor to set the position of the fold SJ is roughly adjusted under the supposition that the position of the fold SJ is equal to the distance D between the sheet leading edge detection position of the sensor SS and the reference position P, however, practically, the relationship between the position of the sensor SS and the position of the fold SJ is obtained by the experiment, and the fine portion is adjusted.

Figure 3:
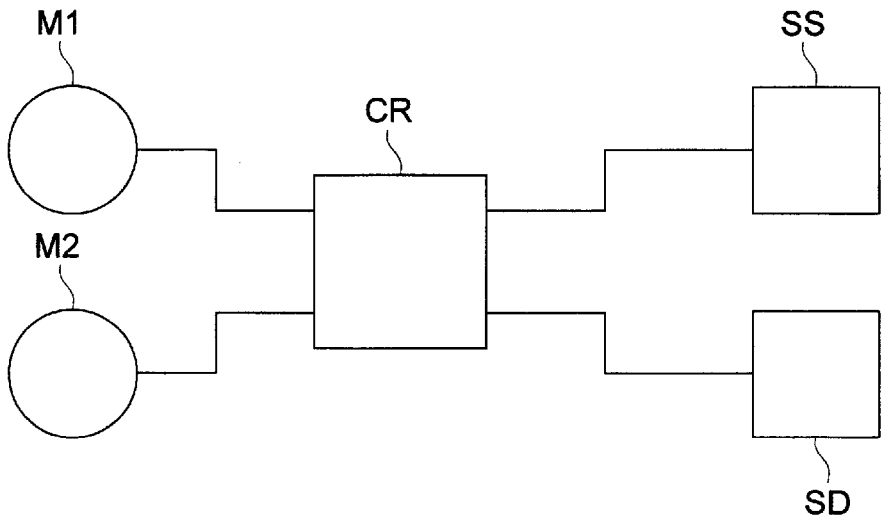
FIG. 3 is a block diagram of a control system of the sheet folding apparatus according to the Embodiment of the present invention.

FIG. 3 is a block diagram of the control system of the sheet folding apparatus according to the embodiment (common to embodiments which will be described later) of the present invention. The control means CR drives the stepping motor M1 and introduces the sheet S, and according to the sheet leading edge detection signal of the sensor SS, stops the stepping motor M1. Next, it drives the solenoid SD and brings the second pressure-contact roller R4 into contact with the second folding roller R2, and drives the stepping motor M1 in the reversed direction to the direction in the introduction process, and drives the stepping motor M2, and drives the first folding roller R1 and the second folding roller R2 in the reversal direction to each other, and conducts the folding of the sheet S.

The sensor SS is set at the position corresponding to the folding mode and sheet size. Further, the position of the sensor SS can be fixed. In the structure in which the sensor SS is fixed, the timer provided in the control means CR is started by the output of the sheet leading edge detection signal of the sensor SS, and the introduction process of the sheet is completed by the timer. The folding position is changed corresponding to the folding mode or sheet size by changing the clocking time of the timer.

Further, the position of the sensor SS may be the upstream, other than the downstream of the first and second folding rollers R1 and R2.

As described above, in the present embodiment, because the force giving the bend to the sheet is supplied from the first and second conveying means which are provided in a short distance sandwiching the bent position, the fold SJ is formed at the correct position in the sheet S. The position of the fold SJ is set by the sensor SS, and the position of the sensor SS can be easily and correctly set, and can be arbitrarily changed. By the change of the position of the sensor SS or the change of the clocking time of the timer, the setting of the folding position corresponding to the folding mode of two-folding or three-folding or sheet size can be correctly conducted.

Figure 4:
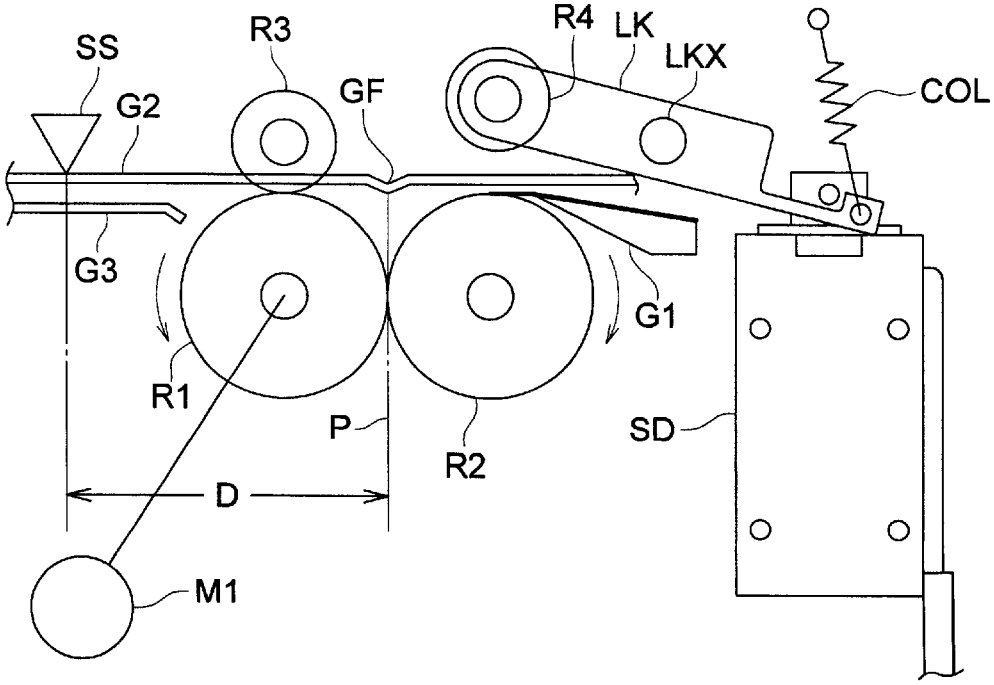
FIG. 4 is a view showing the structure of the sheet folding apparatus according to an Embodiment 2 of the present invention.

FIG. 4 shows a sheet folding apparatus according to the Embodiment 2 of the present invention. In the Embodiment 2, as the guide member Gl introducing the sheet S into the folding apparatus, an elastic plate formed of PET is used. The guide member G1 prevents the sheet S from contacting with the surface of the second folding roller R2 which is rotated in the reversal direction to the conveying direction at the time of introduction.

Further, the second folding roller R2 is structured as the driven roller which is driven by the first folding roller R1. In the introduction process, the second folding roller R2 is driven by the first folding roller R1 and rotated clockwise as shown in the drawing, and in the folding process, it is driven by the first folding roller R1 whose rotation direction is reversed, and rotated counterclockwise. In the folding process, because the second pressure-contact roller R4 is brought into contact with the second folding roller R2 when the solenoid SD is turned off, the reverse conveying force by the first and second conveying means is exerted on the sheet S, and the sheet S is folded.

FIGS. 5(*a*) and 5(*b*) are views showing the structure of the sheet folding apparatus according to the Embodiment 3 of the present invention. The first conveying means has the first folding roller R1 as the first rotary folding body, and the first pressure-contact roller R3 as the first pressure-contact rotation body, and the second conveying means has the second folding roller R2 as the second rotary folding body, and the second pressure-contact roller R4 as the second pressure-contact rotation body.

The rotation axis of the first folding roller R1, the first pressure-contact roller R3 and second pressure-contact roller R4 is fixed, and the first pressure-contact roller R3 is rotated by being driven by the first folding roller R1. The rotation axis of the second folding roller R2 is provided to the lever LK, and is displaceable, and the second folding roller R2 is brought into contact with-separated from the fist folding roller R1 and second pressure-contact roller R4. When the second pressure-contact roller R4 is contacted with the second folding roller R2, it is rotated by being driven by the second folding roller R2. Codes G1–G3 are the guide members to guide the sheet, and the guide member G2 has the protruded portion GF as the guide means at the middle position between the first conveying means and the second conveying means. The protruded portion GF regulates the bend of the sheet to the one direction (downward in the drawing). The lever LK is rotatably supported by the axis LKX, and its one end (lower end in the drawing) is connected to the solenoid SD, and the second folding roller R2 is supported by the other end. The lever LK is urged clockwise by the coil spring COL, and when the solenoid SD is turned on, it is rotated counterclockwise, and as shown FIG. 5(*b*), the second folding roller R2 is brought into pressure-contact with the first folding roller R1, and when the solenoid SD is turned off, as shown in FIG. 5(*a*), the second folding roller R2 is separated from the first folding roller R1. The lever LK to displace the rotation axis of the second folding roller R2 and the solenoid SD structure the displacement means.

Code SS is a sensor as a detection means for detecting the leading edge of the sheet, and the optical sensor or micro switch is used.

FIGS. 6(*a*)–6(*c*) show the folding process of the sheet folding method according to the Embodiment 3 of the present invention, and FIG. 6(*a*) shows the introduction process, FIG. 6(*b*) shows the start stage of the folding process, and FIG. 6(*c*) shows the folding process.

In the introduction process in FIG. 6(*a*), the solenoid SD is turned off, and the second folding roller R2 is separated from the first folding roller R1 by an urge of the coil spring COL.

The first folding roller R1 is rotated as shown by an arrow counterclockwise by the stepping motor M1 as the drive means, and the sheet S is conveyed as shown by an arrow from right to left, and introduced between the first folding roller R1 and the first pressure-contact roller R3, and between the second folding roller R2 and the second pressure-contact roller R4. In this connection, in the introduction process, the second folding roller R2 and the second pressure-contact roller R4 are stopped, and the sheet P passes between them.

FIG. 6(*b*) shows the start stage of the folding process in which, according to the sheet leading edge detection signal of the sensor SS, the conveying of the sheet is stopped, and the second pressure-contact roller R4 is brought into contact with the second folding roller R2.

At the stage at which the sensor SS detects the leading edge of the sheet S, the first folding roller R1 is stopped, and the solenoid SD is turned on, and the second folding roller R2 is displaced and brought into contact with the first folding roller R1 and the second pressure-contact roller R4. The first, second pressure-contact rollers R3, R4 are brought into pressure-contact with the first and second folding rollers R1 and R2 by a predetermined pressure so that the first and second conveying means have the conveying force which can give the bend to the sheet S.

Next, by the counterclockwise rotation of the second folding roller R2 by the stepping motor M2 as the clockwise rotation and drive means of the first folding roller R1 by the stepping motor M1 as the drive means, because the conveying force which are reverse directions to each other is applied onto the sheet S by the first conveying means and the second conveying means, as shown in FIG. 6(*c*), the sheet S is bent and the fold SJ is formed. By the rotation of the first and second folding rollers R1 and R2, the fold SJ passes between these rollers, and the sheet S is folded.

In the bending start of the sheet S in the initial stage of the process of FIG. 6(*c*), the protruded portion GF of the guide member G2 acts as the guide member to give the bend in a predetermined direction at the predetermined position of the sheet S. The protruded portion GF is formed in such a manner that its apex is positioned at the middle position between the nip between the first folding roller R1 and the first pressure-contact roller R3, and the nip between the second folding roller R2 and the second pressure-contact roller R4.

The position at which the fold SJ is formed, is an almost intermediate position, and as shown in FIG. 5, it is the reference position P which is a projection position to the introduction path of the contact position of the first folding roller R1 with the second folding roller R2. In this manner, it can be said that the reference position P is the position on the introduction path of the tangent line of the outer periphery of the first folding roller R1 which is the fixed roller.

The position of the fold SJ on the sheet S is set by the sheet leading edge detection position of the sensor SS, and the position of the sensor to set the position of the fold SJ is roughly adjusted under the supposition that the position of the fold SJ is equal to the distance D between the sheet leading edge detection position of the sensor SS and the reference position P, however, practically, the relationship between the position of the sensor SS and the position of the fold SJ is obtained by the experiment, and the fine portion is adjusted.

Also in the Embodiment 3 shown in FIGS. 5(*a*)–5(*b*), 6(*a*)–6(*c*), the second folding roller R2 is structured as the driven roller, and in the folding process, it can be structured that the first folding roller R1 drives the second folding roller R2.

Figure 7:
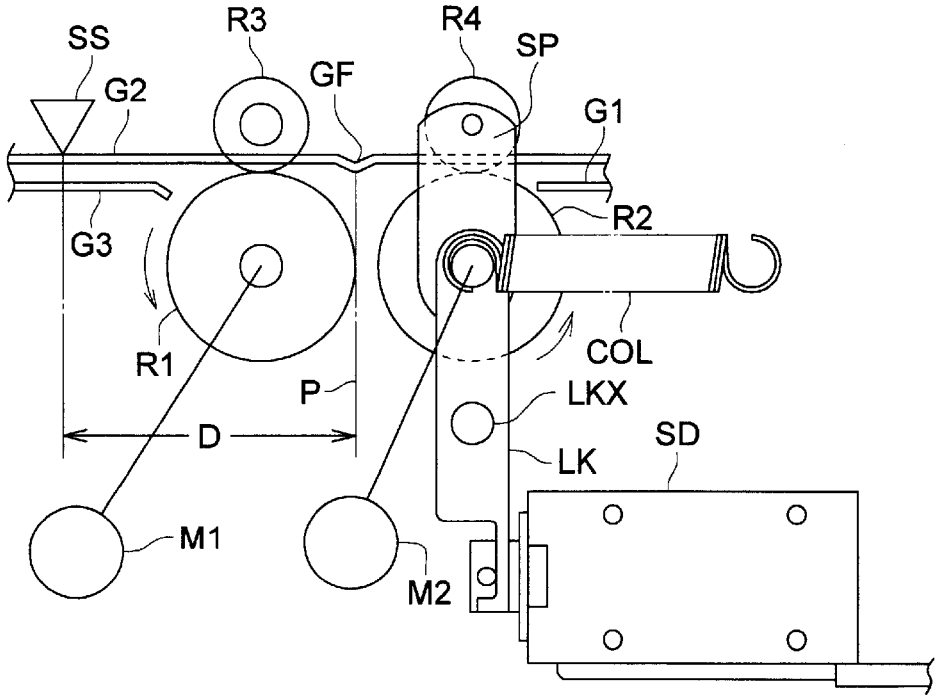
FIGS. 7(*a*) and 7(*b*) are views showing the structure of the sheet folding apparatus according to an Embodiment 4 of the present invention.
Figure 7:
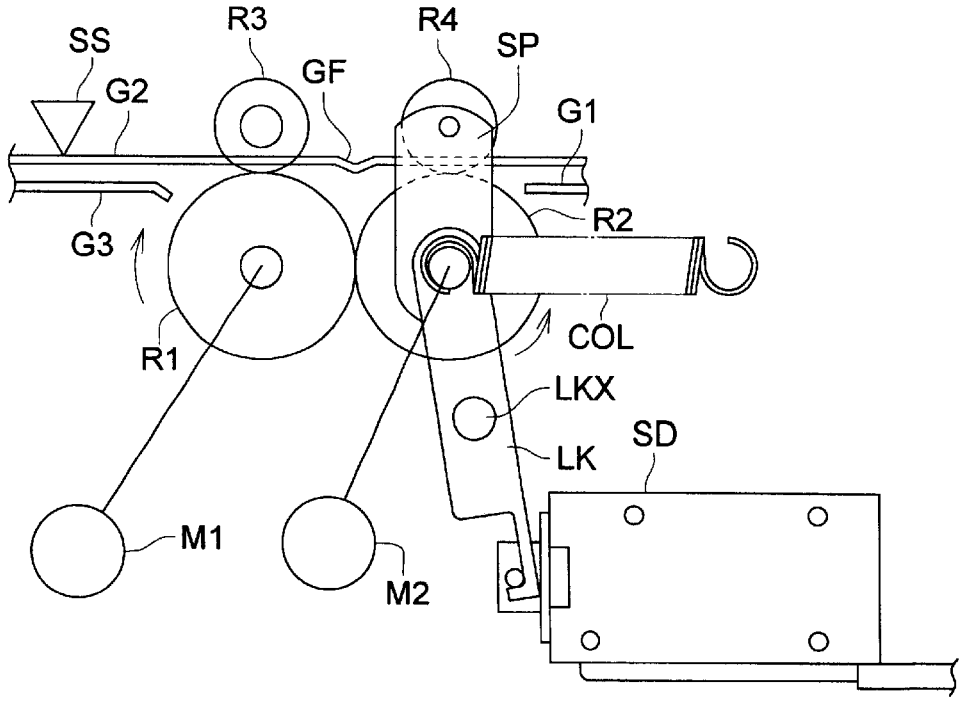

FIGS. 7(*a*) and 7(*b*) show the structure of the sheet folding apparatus according to the Embodiment 4 of the present invention. In the Embodiment 4, in the introduction process, as shown in FIG. 7(*a*), the first folding roller R1 is separated from the second folding roller R2, and the first pressure-contact roller R3 is in contact with the first folding roller R1, and the second pressure-contact roller R4 is in contact with the second folding roller R2. Then, by the motors M1 and M2, the first and second folding rollers R1 and R2 are rotated in the same counterclockwise direction and the sheet is introduced.

In the folding process, as shown in FIG. 7(*b*), the solenoid SD is turned on, and the support plate SP supporting the second folding roller R2 and the second pressure-contact roller R4, is moved, and the second folding roller R2 is brought into contact with the first folding roller R1. Then, the rotation direction of the motor M1 is reversed, and the first folding roller R1 is rotated clockwise. In the second folding roller R2, the one-way clutch is assembled, and the second folding roller is driven by the first folding roller R1 which is rotated clockwise, and is rotated counterclockwise. Accordingly, the sheet is folded by the first and second folding rollers.

Figure 8:
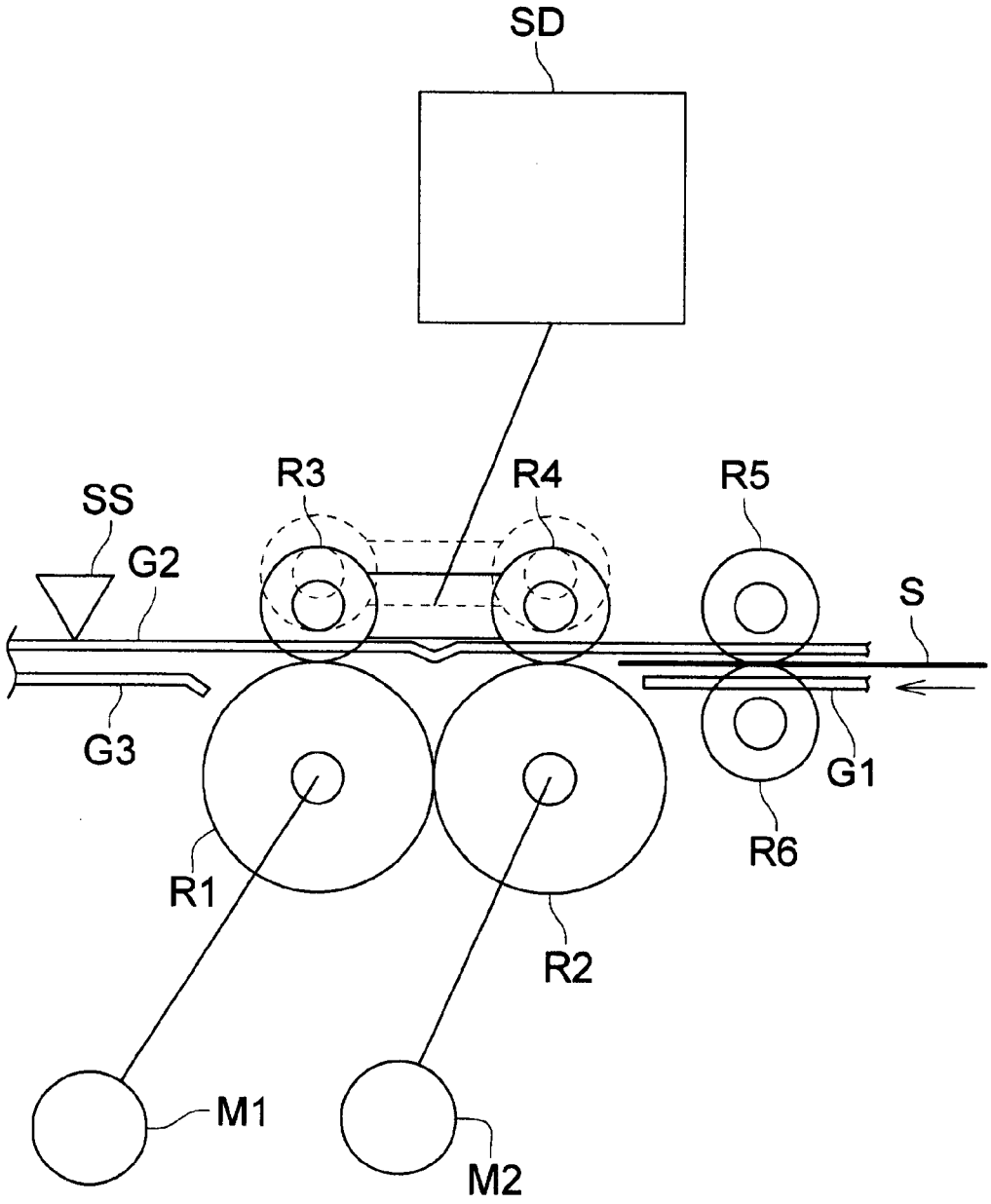
FIG. 8 is a view showing the structure of the sheet folding apparatus according to an Embodiment 5 of the present invention.

FIG. 8 shows the structure of the sheet folding apparatus according to the Embodiment 5 of the present invention. The Embodiment 5 has the introduction means for introducing the sheet S into the sheet folding apparatus, and the introduction means is composed of a pair of conveying rollers R5 and R6. Further, in the present example, the first and second pressure-contact rollers R3 and R4 are brought into contact with and separated from the first and second folding rollers R1 and R2 by the solenoid SD, respectively. The solenoid SD to displace the first and second pressure-contact rollers R3, R4 structures the displacement means.

In the introduction process of the sheet, the first and second pressure-contact rollers R3 and R4 are placed in the position of the dotted line, and separated from the first and second folding rollers R1 and R2, respectively, and the sheet S is conveyed by the conveying rollers R5 and R6, and introduced into the sheet folding apparatus.

In the folding process, the first and second pressure-contact rollers R3, R4 are brought into contact with the first and second folding rollers R1 and R2, respectively, and the these folding rollers R1 and R2 are rotated in the reverse direction to each other and the folding is conducted. Also in the Embodiment 5, any one of the first and second folding rollers R1 and R2 is made a drive roller, and the other can be made a driven roller.

Figure 9:
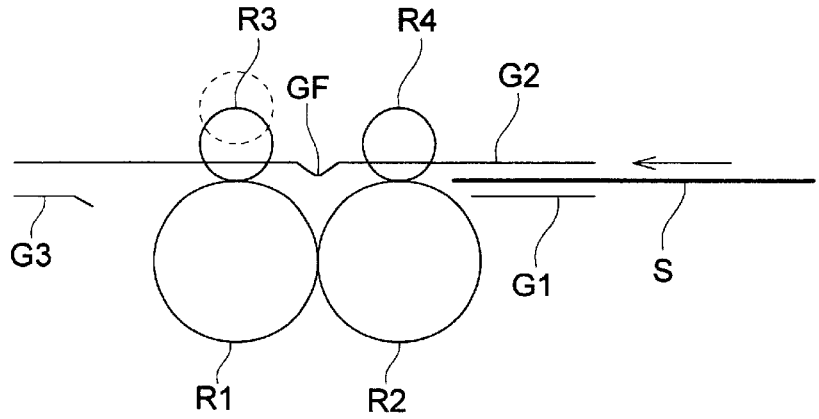
FIGS. 9(*a*)–9(*c*) are views showing modified examples of the sheet folding apparatus.
Figure 9:
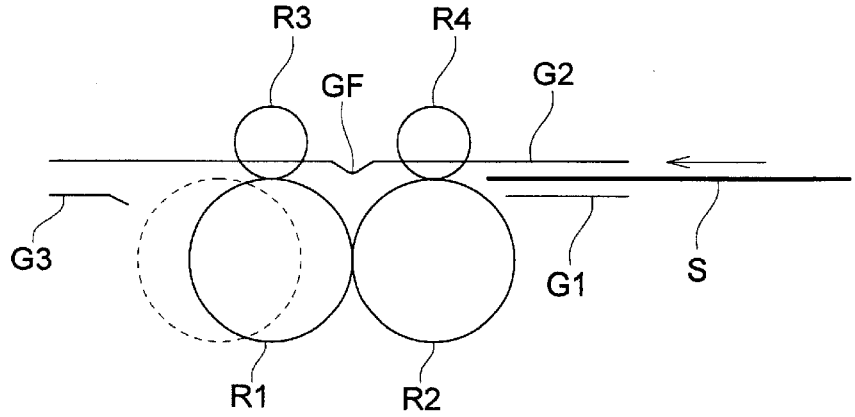
Figure 9:
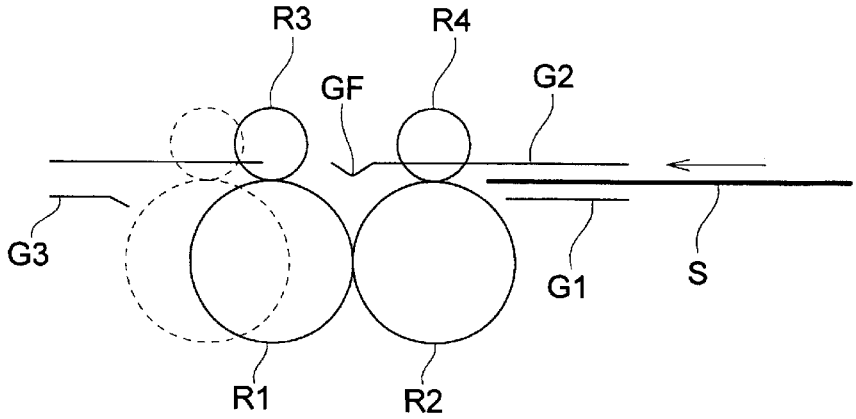

FIGS. 9(*a*)–9(*c*) show modified examples of the sheet folding apparatus. The example of FIG. 9(*a*) is an example in which the fist pressure-contact roller R3 which pressure-contacts with the first folding roller R1 of the downstream side in the conveying direction in the introduction process is made displaceable, and the rotation axis of the second pressure-contact roller R4 which pressure-contacts with the second folding roller R2 of the upstream side is made a fixed axis. In the introduction process of the sheet S, the sheet is conveyed and introduced by the second folding roller R2 and the second pressure-contact roller R4.

The example of FIG. 9(*b*) is an example in which the rotation axis of the first folding roller R1 of the downstream side in the conveying direction in the introduction process is made displaceable, and the rotation axes of the second folding roller R2 of the upstream side and the first and second pressure-contact rollers R3, R4 are made fixed axes. In the introduction process of the sheet, the sheet is conveyed and introduced by the second folding roller R2 and the second pressure-contact roller R4.

In FIG. 9(*c*), the rotation axes of the first folding roller R1 and the first pressure-contact roller R3, of the downstream side in the conveying direction in the introduction process, are made displaceable, and the in the introduction process, the first folding roller R1 and the second folding roller R2 are separated from each other, and the first and second folding rollers R1 and R2 are rotated in the same directions and the sheet is conveyed and introduced. In the folding process, the folding is conducted when the first folding roller R1 and the first pressure-contact roller R3 are displaced, and the first folding roller R1 is brought into pressure-contact with the second folding roller R2, and the first folding roller R1 is rotated clockwise.

Figure 10:
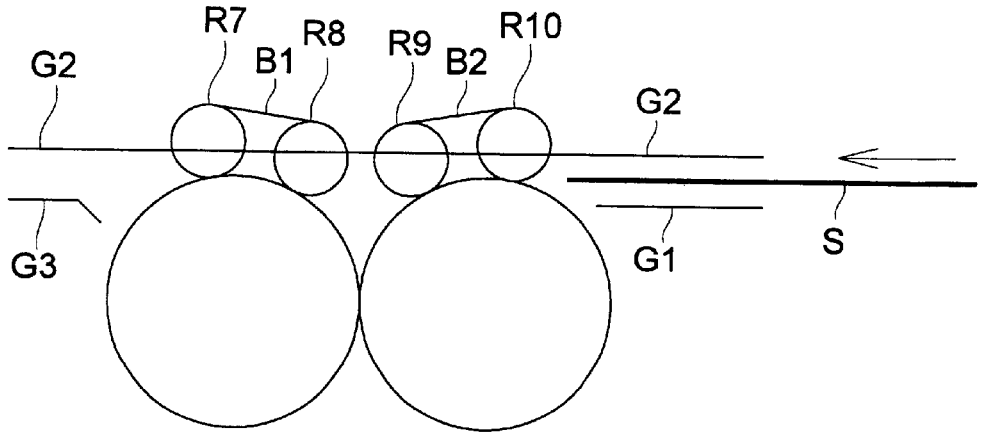
FIGS. 10(*a*) and 10(*b*) are views showing modified examples of a rotary folding body and rotary pressure-contact body.
Figure 10:
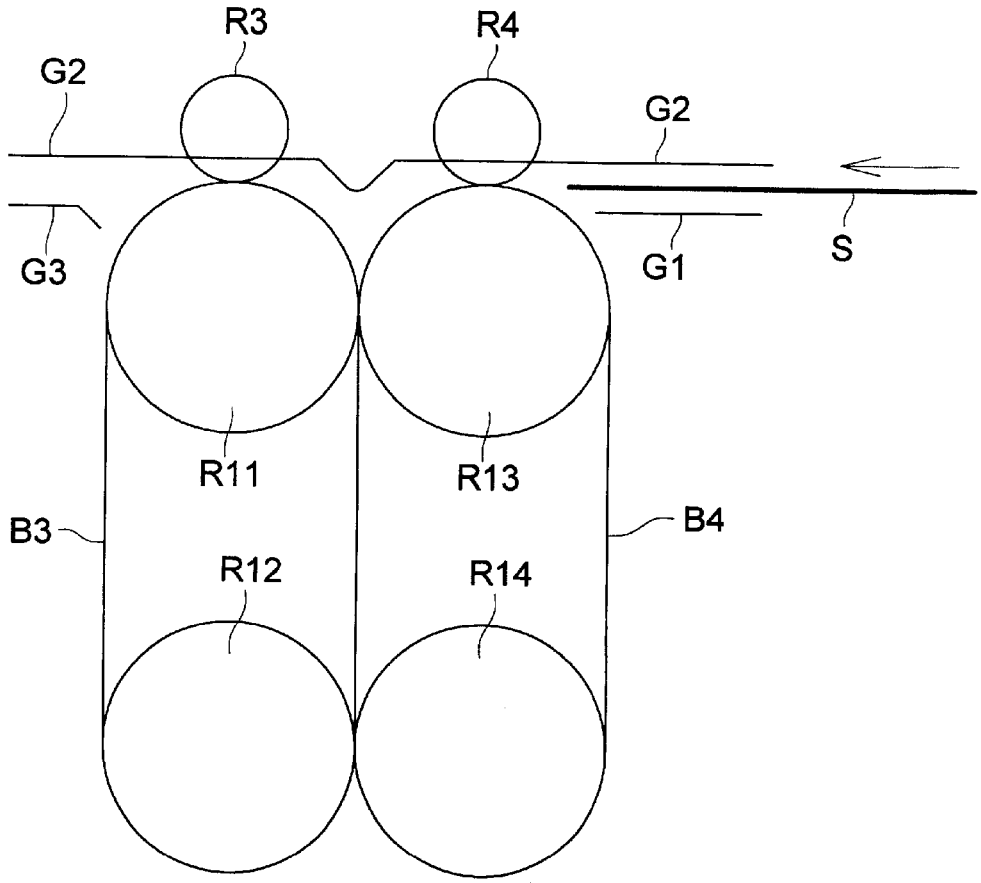

FIGS. 10(*a*) and 10(*b*) show the modified examples of the rotary folding body and the pressure-contact rotation body. FIG. 10(*a*) is an example in which belts are used instead of the roller as the pressure-contact rotation body, and a belt B1 as the first pressure-contact rotation body trained around rollers R7 and R8, and a belt B2 as the second pressure-contact rotation body trained around rollers R9 and R10, are used. Rollers R8 and R9 can be used as the guide means which gives the bend onto the sheet S in the one direction. FIG. 10(*b*) is an example in which belts are used instead of the roller as the rotary folding body, and a belt B3 as the first rotary folding body trained around rollers R11 and R12, and a belt B4 as the second rotary folding body trained around rollers R13 and R14, are used.

<Image Forming Apparatus>

Figure 11:
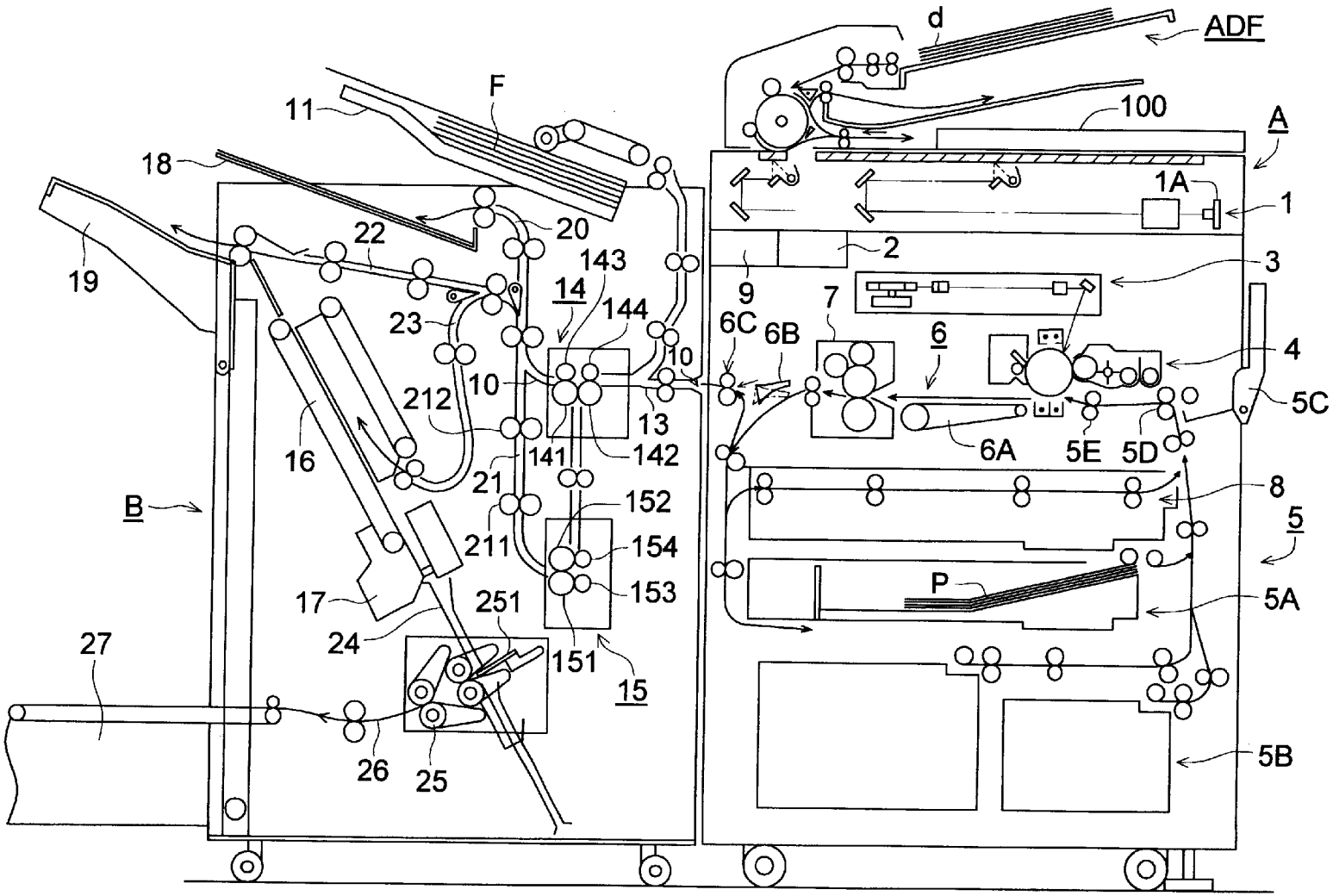
FIG. 11 is a view showing an image forming apparatus according to the embodiment of the present invention.

FIG. 11 shows an image forming apparatus according to the embodiment of the present invention.

The image forming apparatus A is provided with an image reading means 1, image processing means 2, image writing means 3, image forming means 4, sheet feeding means 5, conveying means 6, fixing means 7, re-conveying means (automatic double-side copy conveying section ADU) 8, and control means 9.

The sheet feeding means 5 is provided with a cassette sheet feeding section 5A and large capacity sheet feeding section (LCT) 5B, manual sheet feeding section 5C, intermediate sheet feeding roller 5D, and registration roller 5E.

The conveying means 6 is provided with a conveying belt 6A, conveying path switching plate 6B, and sheet delivery roller 6C.

In the upper portion of the image forming apparatus main body A, an automatic document feeding apparatus ADF is mounted. To the sheet delivery roller 6C side of the left side surface in the drawing of the image forming apparatus main body A, a sheet finisher B is connected.

The document d placed on a document table of the automatic document feeding apparatus ADF is conveyed in the arrowed direction and by an optical system of the image reading means 1, the image on the single side or double sides of the document is read out, and is read into a CCD image sensor 1A.

An analog signal which is photoelectric converted by the CCD image sensor 1A, after analog processing, A/D conversion, shading correction, and image compression processing are conducted in the image processing means, is sent to the image writing means 3.

In the image writing means 3, the output light from the semiconductor laser is radiated onto the photoreceptor drum of the image forming means 4, and a latent image is formed. In the image forming means 4, the processing such as charging, exposing, transferring, separation, and cleaning is conducted. Onto the sheet S fed from the sheet feeding means 5, an image is transferred in the transfer section.

The sheet S on which the image is carried is conveyed by the conveying belt 6A, and fixed by the fixing means 7, and sent from a sheet delivery roller 6C into a receiving section 10 of the sheet finisher B. Alternatively, the sheet S on whose surface the image is formed, which is sent into the re-conveying means 8 by the conveying path switching plate 6B is, in the image forming means 4 again, the image is formed on the rear surface, and delivered from the sheet delivery roller 6C. The sheet S delivered from the sheet delivery roller 6C is sent into the receiving section 10 of the sheet finisher B.

In the sheet finisher B is provided with the sheet receiving section 10 which receives the sheet S on which the image is formed, sheet feeding apparatus 11 which feeds the additional sheet such as a cover and inter sheet, first sheet folding section 14 which folds the sheet S, second sheet folding section 15 which folds the sheet S, intermediate tray 16, stapling apparatus 17, fixed delivery sheet tray 18, elevation delivery sheet tray 19 which can move up and down, center folding apparatus 25, and fixed delivery sheet section 27, and these apparatus or sections are connected by conveying paths 13, 20, 21, 22, 23, and 26.

Next, the operation of the sheet finisher B will be described. The sheet S received in the sheet receiving section 10 of the sheet finisher B is conveyed to the first sheet folding section 14 through the conveying path 13.

In the mode in which the folding is not conducted, the sheet S conveyed on the conveying path 13 is conveyed in the horizontal direction in FIG. 11 by the first folding roller 141, first pressure-contact roller 143, second folding roller 142 and second pressure-contact roller 144 which form the conveying path, and sent to the after processing section.

In the mode in which the after processing is not conducted and the sheet is delivered, the sheet S is delivered onto the fixed sheet delivery tray 18 through the sheet delivery path 20.

In the staple mode, the sheet S is, through the conveying path 23, conveyed to the intermediate tray 16, and after a predetermined number of sheets are stacked on the intermediate tray 16, the sheets S are stapling processed by the staple processing apparatus 17. The sheets S which are stapling processed without fold processing are conveyed upward on the intermediate tray 16 after staple processing, and delivered on the elevation sheet delivery tray 19.

The sheet S which is folded and staple processed is delivered onto the elevation sheet delivery tray 19 through the intermediate tray 16 after staple processing.

In the mode in which a large number of sheets of images are formed, even in the case where staple processing is not conducted, the recording sheets S are delivered on the elevation sheet delivery tray 19. That is, the sheet S passes through the conveying path 21, or not through it, and the sheet S is delivered onto the elevation sheet delivery tray 19 from the conveying path 22.

In the mode in which the stapled sheet S is center-folded, the stapled sheet S is introduced into the center-folding apparatus 25 by which the fold processing is conducted by the knife-like folding member 251, and after the center-folding is conducted, the sheet S is delivered to the fixed sheet delivery section 27 through the conveying path 26.

In the mode in which the additional sheet F such as the cover, rear cover, or partition sheet, is attached to the volume of the sheets S for every set number of sheets, the additional sheet F is supplied from the sheet feed apparatus 11, and joins the conveying path 13, and after the processing such as the folding and staple processing is conducted, it is delivered onto the elevation sheet delivery tray 19 or fixed sheet delivery section 27.

In the folding mode, for the sheet S, for example, the first fold processing is conducted at the position of ¼ from its leading edge, by the first sheet folding section 14, and further, the fold processing is conducted at the position of ¼ from the leading edge of the folded sheet S by the second sheet folding section 15, and the sheet S is, for example, Z-folded. In this connection, the position of ¼ means ¼ of the whole length of the sheet S which is not fold processed. Accordingly, in the Z-fold processing, the Z-fold processing in which the first fold is formed at the position of ¼ from the leading edge of the sheet, and the second fold is formed at the position of ½ of the sheet, is conducted.

For the first sheet folding section 14 and second sheet folding section 15, the sheet folding apparatus shown in FIGS. 1(*a*)–1(*b*), 4, 5(*a*)–5(*b*), 7(*a*)–7(*b*), or 8, is used. That is, the first folding roller 141 as the first rotary folding body in the first sheet folding section 14 corresponds to the first folding roller R1 shown in FIGS. 1(*a*)–1(*b*), 4, 5(*a*)–5(*b*), 7(*a*)–7(*b*), or 8, the second folding roller 142 as the second rotary folding body corresponds to the second folding roller R2, the first pressure-contact roller 143 as the first pressure-contact rotation body corresponds to the fist pressure-contact roller R3, and the second pressure-contact roller 144 as the second pressure-contact rotation body corresponds to the second pressure-contact roller R4, respectively. Further, the first folding roller 151 as the third rotary folding body in the second sheet folding section 15 corresponds to the first folding roller R1 shown in FIGS. 1(*a*)–1(*b*), the second folding roller 152 as the fourth rotary folding body corresponds to the second folding roller R2, the first pressure-contact roller 153 as the third pressure-contact rotation body corresponds to the first pressure-contact roller R3, and the second pressure-contact roller 154 as the fourth pressure-contact rotation body corresponds to the second pressure-contact roller R4, respectively. The first folding roller 141 and the first pressure-contact roller 143 structure the first conveying means, the second folding roller 142 and the second pressure-contact roller 144 structure the second conveying means, the first folding roller 151 and the first pressure-contact roller 153 structure the third conveying means, and the second folding roller 152 and the second pressure-contact roller 154 structure the fourth conveying means.

Figure 12:
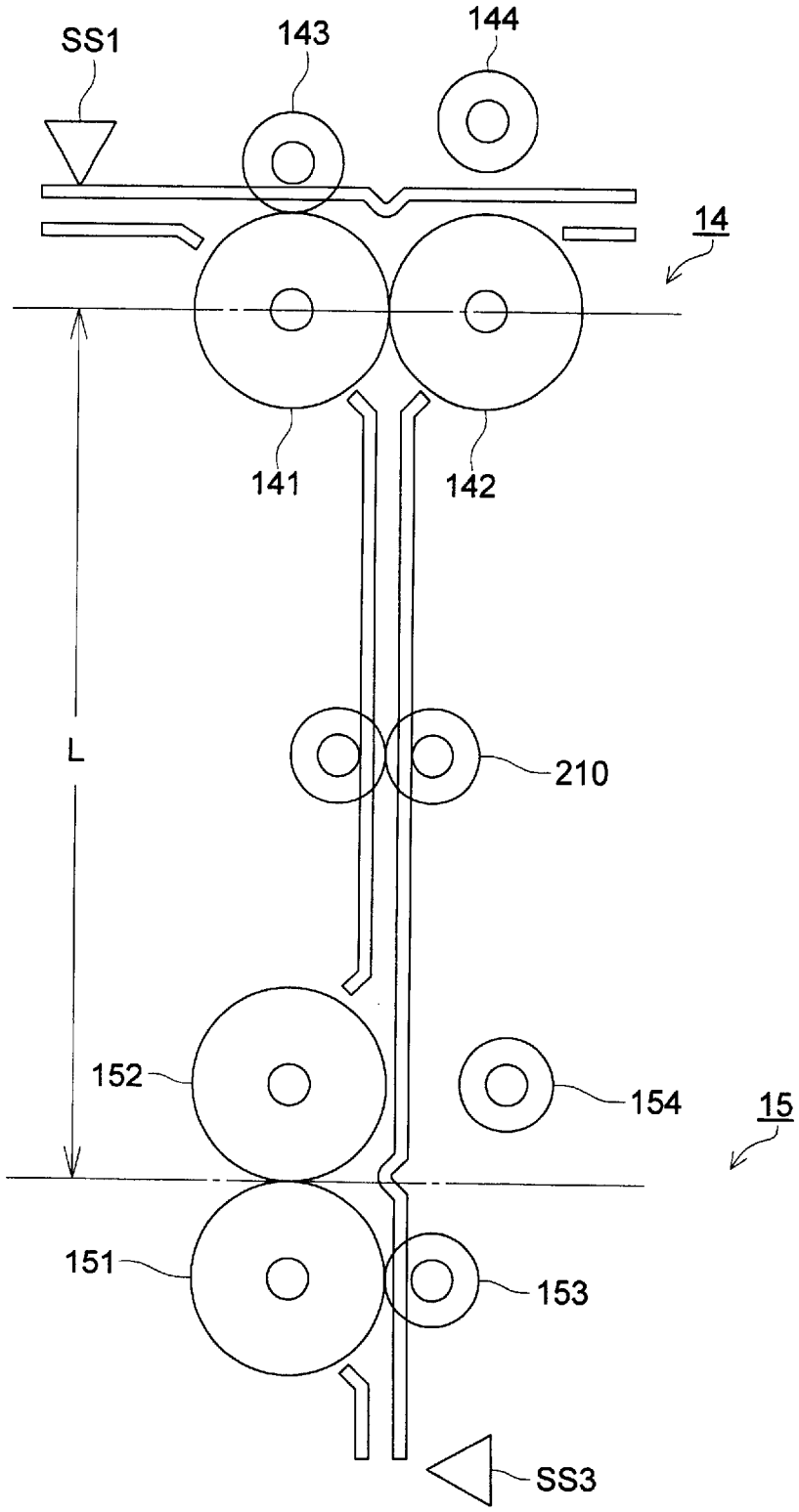
FIG. 12 is an enlarged view of the first and second sheet folding sections.

FIG. 12 is an enlarged view of the first and second sheet folding sections 14 and 15. The second sheet folding section 15 is placed just below the first sheet folding section 14, and the sheet conveyed horizontally from the right is processed in such a manner that its running direction is changed to the right angle direction in the first sheet folding section 14, and it runs downward, and is sent to the second sheet folding section 15, and in the second sheet folding section 15, it is fold processed. It is preferable that the distance L between the first sheet folding section 14 and the second sheet folding section 15 is set longer than the length in the conveying direction of the sheet to be conveyed, that is, longer than ½ of the length of the longest sheet to be processed. When the distance L is shorter than the above length of the sheet, there is a case where the sheet stretches over the first and second sheet folding sections 14 and 15 and is conveyed, thereby, there is a possibility that the case in which the conveying is not smoothly conducted, is generated.

In FIG. 13(*a*), under the condition that the first folding roller 141 is brought into contact with the second folding roller 142, the first folding roller 141 is brought into contact with the first pressure-contact roller 143, and the second folding roller 142 is separated from the second pressure-contact 144, the first folding roller 141 is rotated counterclockwise and the sheet S is conveyed and introduced into the first sheet folding section 14. In the stage in which the sheet S is conveyed by D=(¼)×PL (PL: length of the sheet) from the reference position P, by the sheet leading edge detection signal of the sensor SS1, the drive of the first folding roller is stopped, and the first introduction process in FIG. 13(*a*) is completed and the sequence advances to the first folding process in FIG. 13(*b*).

In FIG. 13(*b*), the second pressure-contact roller 144 is brought into pressure-contact with the second folding roller 142, and the first folding roller 141 is rotated in reverse direction (clockwise) to that in the first introduction process, and the second folding roller 142 is rotated counterclockwise, respectively, the conveying force is applied onto the sheet S by the first and second conveying means in the reverse direction to each other and the folding is started. Further, as in FIG. 13(*c*), the rotation of the first and second folding rollers 141 and 142 is continued and the folding is conducted, and the folded sheet S is conveyed by the conveying roller 210 (refer to FIG. 12), and introduced into the second sheet folding section 15.

As shown in FIG. 13(*d*), under the condition that the first folding roller 151 is brought into contact with the second folding roller 152, the first folding roller 151 is brought into contact with the first pressure-contact roller 153, and the second folding roller 152 is separated from the second pressure-contact 154, in the second sheet folding section 15, the first folding roller 151 is rotated and the second introduction process is conducted, and the sheet S is introduced into the second sheet folding section 15.

In the stage in which the leading edge of the folded sheet S is conveyed by a predetermined distance D=(¼)×PL from the reference position P, the drive of the first folding roller 151 is stopped according to the detection signal of the sensor SS2, and the second pressure-contact roller 154 is brought into pressure-contact with the second folding roller 152.

As shown in FIG. 13(*e*), the second folding process is started after the pressure-contact, and the rotation direction of the first folding roller 151 is reversed and the sheet S is folded. As shown in FIG. 13(*f*), the rotation of the first and second folding rollers 151 and 152 is continued and while the sheet S is being folded, the sheet s is delivered from the second sheet folding section 15.

Sensors SS1 and SS2 are arranged at various positions corresponding to the folding mode or sheet size.

As shown in FIG. 11, in the process in which the fold processing of three-folding is conducted, the sheet S is conveyed from the conveying path 10 as a main conveying path to the conveying path 21 as a branch conveying path by the first and second folding rollers 141, 142, and the first and second pressure-contact rollers 143 and 144, structuring the first sheet folding section 14 as a branch section, and conveyed by the conveying roller 210, the second sheet folding section 15 and conveying rollers 211 and 212, joins the conveying path 10.

FIGS. 13(*a*)–13(*f*) are referred to again. The sheet S is introduced from the direction X1 to the first sheet folding section 14, and conveyed and sent from the first sheet folding section 14 to the second sheet folding section 15 in the direction X2 almost perpendicular to the direction X1. The sheet S folded by the second sheet folding section 15 is conveyed in the direction X3 almost perpendicular to the direction X2, that is, in almost the same direction X3 as the direction X1.

As shown in FIGS. 13(*a*)–13(*f*), when the sheet S folded by the first and second sheet folding sections 14 and 15 is further conveyed by almost perpendicularly turning the direction from the direction X3, the sheet S branched from the conveying path 10 as the main conveying path by the first sheet folding section 14 is conveyed on the conveying path 21, and is made to join the conveying path 10 by conveying rollers 211 and 212.

Figure 14:
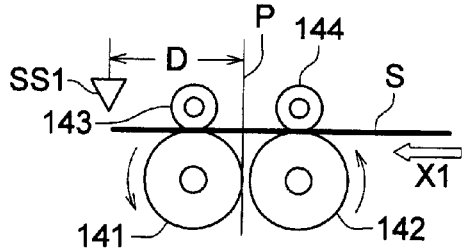
FIGS. 14(*a*)–14(*f*) are views showing another example of the Z-folding process to fold 2 portions of the sheet.
Figure 14:
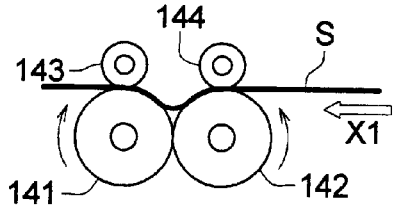
Figure 14:
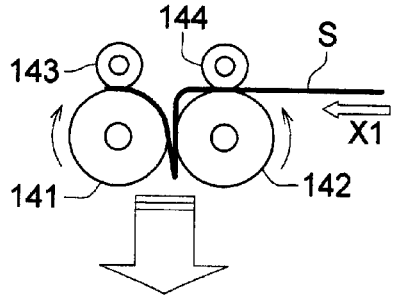
Figure 14:
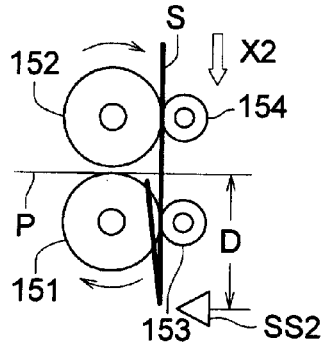
Figure 14:
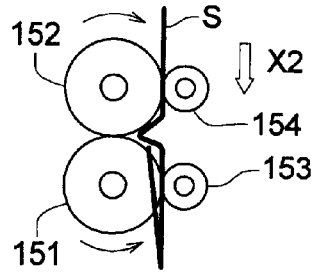
Figure 14:
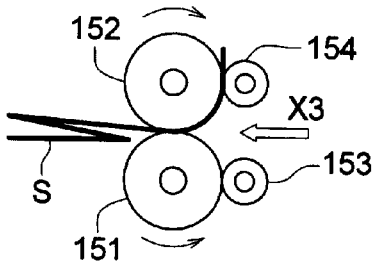

FIGS. 14(*a*)–14(*f*) show another example of the Z-folding process in which the sheet folding apparatus shown in FIGS. 5(*a*)–5(*b*) is used for the first and second sheet folding sections 14 and 15 in FIG. 11, and two portions of the sheet S are folded. In this connection, the stepping motors M1 and M2, guide members G1–G3 and solenoid SD in FIGS. 5(*a*)–5(*b*) are neglected, however, the first and second sheet folding sections 14 and 15 have these components, and the stepping motors M1 and M2 of the first sheet folding section 14 structure the first drive means, the guide member G2 structures the first guide means, and the solenoid SD structures the first displacement means, respectively. Then, the stepping motors M1 and M2 of the second sheet folding section 15 structure the second drive means, the guide member G2 structures the second guide means, and the solenoid SD structures the second displacement means, respectively.

In FIG. 14(*a*), under the condition that the first folding roller 141 and first pressure-contact roller 143, the folding roller 142 and the second pressure roller 144 are in pressure-contact with each other, respectively, and the first folding roller 141 is separated from the second folding roller 142, the first folding roller 141 and second folding roller are rotated counterclockwise, and the sheet S is conveyed and introduced into the first sheet folding section 14. In the stage in which the sheet S is conveyed from the reference position P by a predetermined distance D=(¼)×PL (PL is the length of the sheet), by the sheet leading edge detection signal of the sensor SS1, the drive of the folding roller 141 is stopped, the first introduction process in FIG. 14(*a*) is completed, and the sequence advances to the first folding process in FIG. 14(*b*).

In FIG. 14(*b*), the second folding roller 142 is brought into pressure-contact with the first folding roller 141, and the first folding roller 141 is rotated in the direction (clockwise) opposite to that in the first introduction process, and the second folding roller 142 is rotated counterclockwise, respectively, and thereby the conveying force is applied to the sheet S in the opposite direction to each other by the first and second conveying means, the folding is started. Further, as in FIG. 14(*c*), the rotation of the first and second folding rollers 141 and 142 is continued and the folding is conducted, and the folded sheet S is conveyed by the conveying roller 210 (refer to FIGS. 11 and 12), and introduced into the second sheet folding section 15.

As shown in FIG. 14(*d*), under the condition that the first folding roller 151 and first pressure-contact roller 153 in the second sheet folding section 15, and second folding roller 152 and second pressure-contact roller 154 are brought into pressure-contact with each other, respectively, and the second folding roller 152 is separated from the first folding roller 151, the first folding roller 151 is rotated, and the second introduction process is conducted, and the sheet S is introduced into the second sheet folding section 15.

In the stage in which the leading edge of the folded sheet S is conveyed from the reference position P by a predetermined distance D=(¼)×PL, according to the detection signal of the sensor SS2, the drive of the first folding roller 151*b* is stopped, and the second folding roller 152 is brought into pressure-contact with the first folding roller 151 and the second pressure-contact roller 154.

As shown in FIG. 14(*e*), after the pressure-contact, the second folding process is started and the rotation direction of the first folding roller 151 is reversed, and the sheet S is folded. As shown in FIG. 14(*f*), the rotation of the first and second folding rollers 151 and 152 is continued, and while the sheet S is being folded, the sheet S is delivered from the second sheet folding section 15.

FIGS. 15(*a*)–15(*f*) show yet another example of the Z-folding process by which, for the first sheet folding section 14, the sheet folding apparatus shown in FIGS. 1(*a*) and 1(*b*) is used, and for the second sheet folding section 15, the sheet folding apparatus shown in FIGS. 5(*a*)–5(*b*) is used, and two portions of the sheet S are folded.

In FIG. 15(*a*), under the condition that the first folding roller 141 and second folding roller 142, the first folding roller 141 and the first pressure-contact roller 143 are in pressure-contact with each other, respectively, and the second folding roller 142 is separated from the second pressure-contact roller 144, the first folding roller 141 is rotated counterclockwise, and the sheet S is conveyed and introduced into the first sheet folding section 14. In the stage in which the sheet S is conveyed from the reference position P by a predetermined distance D=(¼)×PL (PL is the length of the sheet), by the sheet leading edge detection signal of the sensor SS1, the drive of the first folding roller 141 is stopped, and the first introduction process in FIG. 15(*a*) is completed, and the sequence advances to the first folding process in FIG. 15(*b*).

In FIG. 15(*b*), the second pressure-contact roller 144 is brought into pressure-contact with the second folding roller 142, and the first folding roller 141 is rotated in the direction (clockwise) opposite to that in the first introduction process, and the second folding roller 142 is rotated counterclockwise, respectively, thereby the conveying force is applied to the sheet S in the opposite direction to each other by the first and second conveying means, the folding is started. Further, as in FIG. 15(*c*), the rotation of the first and second folding rollers 141 and 142 is continued and the folding is conducted, and the folded sheet S is conveyed by the conveying roller 210 (refer to FIG. 12), and introduced into the second sheet folding section 15.

As shown in FIG. 15(*d*), under the condition that the first folding roller 151 and first pressure-contact roller 153 in the second sheet folding section 15 are respectively brought into pressure-contact with each other, and second folding roller 152 and second pressure-contact roller 154 are brought into pressure-contact with each other, and the second folding roller 152 is separated from the first folding roller 151, the first folding roller 151 is rotated, and the second introduction process is conducted, and the sheet S is introduced into the second sheet folding section 15.

In the stage in which the leading edge of the folded sheet S is conveyed from the reference position P by a predetermined distance D=(¼)×PL, according to the detection signal of the sensor SS2, the drive of the first folding roller 151 is stopped, and the second folding roller 152 is brought into pressure-contact with the first folding roller 151 and the second pressure-contact roller 154.

As shown in FIG. 15(*e*), after the pressure-contact, the second folding process is started and the rotation direction of the first folding roller 151 is reversed, and the sheet S is folded. As shown in FIG. 15(*f*), the rotation of the first and second folding rollers 151 and 152 is continued, and while the sheet S is being folded, the sheet S is delivered from the second sheet folding section 15.

For the first and second sheet folding sections 14 and 15, the sheet folding apparatus of the Embodiments 1 to 5 shown in FIGS. 1(*a*)–1(*b*), 4, 5(*a*)–5(*b*), 7(*a*)–7(*b*) or 8, can be used, and as shown in FIGS. 13(*a*)–13(*f*), and 14(*a*)–14(*f*), the same apparatus may also be used for the first sheet folding section 14 and second sheet folding section 15, or the different apparatus as shown in FIGS. 15(*a*)–15(*f*) can also be used.

Further, it is also possible to conduct the folding process by which the sheet is two-folded by using only the first sheet folding section 14, and the folding sections are provided at three portions or more, and to conduct the folding process of three-folding or more on the sheet.

The three-fold processing will be described below. In FIG. 16(*a*), under the condition that the first folding roller 141 is brought into contact with the second folding roller 142, the first folding roller 141 is brought into contact with the first pressure-contact roller 143, and the second folding roller 142 is separated from the second pressure-contact 144, the first folding roller 141 is rotated counterclockwise and the sheet S is conveyed and introduced into the first sheet folding section 14. In the stage in which the sheet S is conveyed by D=(⅔)×PL (PL: length of the sheet) from the reference position P, by the sheet leading edge detection signal of the sensor SS1, the drive of the first folding roller is stopped, and the first introduction process in FIG. 16(*a*) is completed and the sequence advances to the first folding process in FIG. 16(*b*).

In FIG. 16(*b*), the second pressure-contact roller 144 is brought into pressure-contact with the second folding roller 142, and the first folding roller 141 is rotated in reverse direction (clockwise) to that in the first introduction process, and the second folding roller 142 is rotated counterclockwise, respectively, the conveying force is applied onto the sheet S by the first and second conveying means in the reverse direction to each other and the folding is started. Further, as in FIG. 16(*c*), the rotation of the first and second folding rollers 141 and 142 is continued and the folding is conducted, and the folded sheet S is conveyed by the conveying roller 210 (refer to FIG. 12), and introduced into the second sheet folding section 15.

As shown in FIG. 16(*d*), under the condition that the first folding roller 151 is brought into contact with the second folding roller 152, the first folding roller 151 is brought into contact with the first pressure-contact roller 153, and the second folding roller 152 is separated from the second pressure-contact 154, in the second sheet folding section 15, the first folding roller 151 is rotated and the second introduction process is conducted, and the sheet S is introduced into the second sheet folding section 15. In this case, a sheet urging member U by which the end portion is urged toward the nip point, may be provided.

In the stage in which the leading edge of the folded sheet S is conveyed by a predetermined distance $D=(1/3)\times PL$ from the reference position P, the drive of the first folding roller 151 is stopped according to the detection signal of the sensor SS2, and the second pressure-contact roller 154 is brought into pressure-contact with the second folding roller 152.

As shown in FIG. 16(*e*), the second folding process is started after the pressure-contact, and the rotation direction of the first folding roller 151 is reversed and the sheet S is folded. As shown in FIG. 16(*f*), the rotation of the first and second folding rollers 151 and 152 is continued and while the sheet S is being folded, the sheet s is delivered from the second sheet folding section 15. Each central position of the pressure-contact rollers 153 and 154 can also be arranged so that it is positioned on the nip position side between the folding rollers, compared to each central position of the folding rollers 151 and 152. By this structure, because the sheet which is pushed out toward the tangent direction forms the loop toward the nip point between the folding rollers 151 and 152, the stable folding can be conducted. Further, this structure can be applied to the first sheet folding section 14 and the second sheet folding section 15.

According to any one of the Structures (1)–(17), a small size sheet folding apparatus by which the folds can be formed at positions not smaller than 2 portions of the sheet at correct fold positions, is realized.

According to the Structure (18), because the sheet does not run stretching over two folding sections, the correct and good finish fold processing can be conducted.

According to the Structure (19), a small size sheet finishing apparatus by which the fold processing is conducted at a correct fold position, is realized.

According to the Structure (20), a small size image forming apparatus by which the fold processing is conducted at a correct fold position, is realized.

What is claimed is:

1. A sheet folding method comprising the steps of:

(a) conducting a first introduction step for conveying and introducing a sheet between a first rotary folding body and a first rotary pressure-contact body which constitutes a first sheet conveyor and between a second rotary folding body and a second rotary pressure-contact body which constitutes a second sheet conveyor disposed upstream of the first sheet conveyor;

(b) driving the first rotary folding body and the second rotary folding body to rotate in an opposite direction to each other, in a condition that the first rotary folding body is brought into contact with the first rotary pressure-contact body, the second rotary folding body is brought into contact with the second rotary pressure-contact body, and the first rotary folding body is brought into contact with the second rotary folding body, thereby exerting sheet conveyance force which is opposite to each other by the first sheet conveyor and the second sheet conveyor on the sheet and bending the sheet thus forming a fold on the sheet;

(c) conveying the fold of the sheet between the first rotary folding body and the second rotary folding body, thereby conducting a first folding step for folding the sheet;

(d) conducting a second introduction step for conveying and introducing the sheet which has been folded by the first folding step between a third rotary folding body and a third rotary pressure-contact body which constitutes a third sheet conveyor and between a fourth rotary folding body and a fourth rotary pressure-contact body which constitutes a fourth sheet conveyor disposed upstream of the third sheet conveyor;

(e) driving the third rotary folding body and the fourth rotary folding body to rotate in an opposite direction to each other, in a condition that the third rotary folding body is brought into contact with the third rotary pressure-contact body, the fourth rotary folding body is brought into contact with the fourth rotary pressure-contact body, and the third rotary folding body is brought into contact with the fourth rotary folding body, thereby exerting sheet conveyance force which is opposite to each other by the third sheet conveyor and the fourth sheet conveyor on the sheet and bending the sheet thus forming a fold on the sheet; and (f) conveying the fold of the sheet between the third rotary folding body and the fourth rotary folding body, thereby conducting a second folding step for folding the sheet.

2. The sheet folding method of claim 1, wherein the first introduction step comprises:

bringing the first rotary pressure-contact body into contact with the first rotary folding body;

separating the second rotary pressure-contact body from the second rotary folding body; and conveying and introducing the sheet by the first sheet conveyor.

3. The sheet folding method of claim 1, wherein the first introduction step comprises:

bringing the second rotary pressure-contact body into contact with the second rotary folding body;

separating the first rotary pressure-contact body from the first rotary folding body; and conveying and introducing the sheet by the second sheet conveyor.

4. The sheet folding method of claim 1, wherein the second introduction step comprises:

bringing the third rotary pressure-contact body into contact with the third rotary folding body;

separating the fourth rotary pressure-contact body from the fourth rotary folding body; and conveying and introducing the sheet by the third sheet conveyor.

5. The sheet folding method of claim 1, wherein the second introduction step comprises:

bringing the fourth rotary pressure-contact body into contact with the fourth rotary folding body;

separating the third rotary pressure-contact body from the third rotary folding body; and conveying and introducing the sheet by the fourth sheet conveyor.

6. The sheet folding method of claim 1, wherein the first introduction step comprises:

bringing the first rotary pressure-contact body into contact with the first rotary folding body;

separating the second rotary folding body from the first rotary folding body and the second rotary pressure-contact body; and driving the first rotary folding body, thereby conveying and introducing the sheet by the first sheet conveyor.

7. The sheet folding method of claim 1, wherein the first introduction step comprises:

bringing the second rotary pressure-contact body into contact with the second rotary folding body;

separating the first rotary folding body from the second rotary folding body and the first rotary pressure-contact body; and driving the second rotary folding body, thereby conveying and introducing the sheet by the second sheet conveyor.

8. The sheet folding method of claim 1, wherein the second introduction step comprises:

bringing the third rotary pressure-contact body into contact with the third rotary folding body;

separating the fourth rotary folding body from the third rotary folding body and the fourth rotary pressure-contact body; and driving the third rotary folding body, thereby conveying and introducing the sheet by the third sheet conveyor.

9. The sheet folding method of claim 1, wherein the second introduction step comprises:

bringing the fourth rotary pressure-contact body into contact with the fourth rotary folding body;

separating the third rotary folding body from the fourth rotary folding body and the third rotary pressure-contact body; and driving the second rotary folding body, thereby conveying and introducing the sheet by the fourth sheet conveyor.

10. The sheet folding method of claim 1, wherein the first introduction step comprises:

keeping the first rotary pressure-contact body and the second rotary pressure-contact body separated from the first rotary folding body and the second rotary folding body; and introducing the sheet by an introducing device.

11. The sheet folding method of claim 1, wherein the second introduction step comprises:

keeping the third rotary pressure-contact body and the fourth rotary pressure-contact body separated from the third rotary folding body and the fourth rotary folding body, respectively; and introducing the sheet by an introducing device.

12. The sheet folding method of claim 1, wherein the first introduction step comprises:

separating the first rotary folding body from the second rotary folding body;

keeping the first pressure-contact body and the second pressure-contact body in contact with the first rotary folding body and the second rotary folding body, respectively; and driving the first and second rotary folding bodies to rotate in the same direction, thereby introducing the sheet.

13. The sheet folding method of claim 12, wherein the first introduction step comprises:

driving either one of the first rotary folding body and the second rotary folding body, and making the other to follow.

14. The sheet folding method of claim 1, wherein the second introduction step comprises:

separating the third rotary folding body from the fourth rotary folding body;

keeping the third pressure-contact body and the fourth pressure-contact body in contact with the third rotary folding body and the fourth rotary folding body, respectively; and driving the third and fourth rotary folding bodies to rotate in the same direction, thereby introducing the sheet.

15. The sheet folding method of claim 14, wherein the second introduction step comprises:

driving either one of the third rotary folding body and the fourth rotary folding body, and making the other to follow.

16. The sheet folding method of claim 1, wherein the first and second introduction steps comprise:

guiding the sheet to be bent in one direction by a first guiding device arranged between the first sheet conveyor and the second sheet conveyor, and a second guiding device arranged between the third sheet conveyor and the fourth sheet conveyor.

* * * * *